US006972730B2

(12) United States Patent
Ogawa et al.

(10) Patent No.: US 6,972,730 B2
(45) Date of Patent: Dec. 6, 2005

(54) ANTENNA SYSTEM

(75) Inventors: Masaru Ogawa, Aichi-ken (JP); Kazuo Sato, Aichi-ken (JP); Kunitoshi Nishikawa, Aichi-ken (JP)

(73) Assignees: Kabushiki Kaisha Toyota Chuo Kenkyusho, Aichi-gun (JP); Denso Corporation, Kariya (JP)

( * ) Notice: Subject to any disclaimer, the term of this patent is extended or adjusted under 35 U.S.C. 154(b) by 688 days.

(21) Appl. No.: 09/985,293

(22) Filed: Nov. 2, 2001

(65) Prior Publication Data

US 2002/0118140 A1 Aug. 29, 2002

Related U.S. Application Data

(63) Continuation of application No. 09/689,795, filed on Oct. 13, 2000, now abandoned.

(30) Foreign Application Priority Data

Oct. 14, 1999 (JP) ..... 11-292959
Oct. 10, 2000 (JP) ..... 2000-309276

(51) Int. Cl.[7] ..... G08B 13/14; H01Q 15/02
(52) U.S. Cl. ..... 343/840; 343/781 CA
(58) Field of Search ..... 343/840, 711, 343/713, 754, 755, 761, 781, 782, 786, 779, 756, 910, 836

(56) References Cited

U.S. PATENT DOCUMENTS 4,156,243 A 5/1979 Yorinks et al. ..... 343/779
4,599,623 A 7/1986 Havkin et al. ..... 343/756
4,831,384 A 5/1989 Sefton, Jr. ..... 342/188
5,581,265 A 12/1996 Stirland et al. ..... 343/756
6,169,524 B1 1/2001 Wu et al. ..... 343/910
6,172,650 B1 1/2001 Ogawa et al. ..... 343/836
6,320,509 B1 * 11/2001 Brady et al. ..... 340/572.7

FOREIGN PATENT DOCUMENTS

JP 34-1120 3/1959
JP 7-307616 11/1995
JP 8-78936 3/1996

* cited by examiner

*Primary Examiner*—James Clinger
(74) *Attorney, Agent, or Firm*—Oblon, Spivak, McClelland, Maier & Neustadt, P.C.

(57) ABSTRACT

A feed probe (1), a semicylindrical sub-reflector (2) forming a primary radiator together with the feed probe (1), and a main reflector (3) arranged such that mirror surfaces of said main reflector (3) and the sub-reflector face across the feed probe (1) are all disposed on a ground plate (a recfector face) (4). The main reflector (3) has a predetermined focal point or focal line on which the feed probe (1) is located, and is mounted on the ground plate (4) at a predetermined installation angle θ. A converter (500) for converting linearly and circularly polarized waves is provided on the mirror surface of the main reflector (3). The converter (500) is composed of a plurality of grooves (510) and ridges (512) formed between the grooves, so that a wave component orthogonal to the grooves is reflected at the bottom of the grooves while a wave component parallel to the grooves is reflected on the ridge surface, thereby causing a phase difference according to the height H of the grooves when a radio wave is reflected on the main reflector to thereby perform linear to circular polarization conversion.

37 Claims, 24 Drawing Sheets

ANTENNA SYSTEM

This application is a Continuation of application Ser. No. 09/689,795 Filed on Oct. 13, 2000, now abandoned.

BACKGROUND OF THE INVENTION

1. Field of the Invention

The present invention relates to an antenna system, and more particularly to short, slim antenna for receiving microwave band signals, such as satellite broadcasting signals.

2. Description of Related Art

FIG. 1A shows the configuration of a conventional antenna system as known from, for example, Japanese Patent Laid-Open Publication No. Sho 61-157105. The antenna system is for use in receiving satellite broadcasting signals and the like, and comprises a main reflector 12 and a primary radiator 14 which are connected by a supporting arm 26. The main reflector 12 is formed by a belt-type parabolic cylinder which is parabolic horizontally and straight vertically, and has a straight focal line in the vertical direction. The primary radiator 14 formed by a micro-strip line is arranged on the focal line of the parabolic cylinder of the main reflector 12. As shown in FIGS. 1B and 1C, according to this antenna system, radio waves transmitted from an artificial satellite are reflected by the main reflector 12, and the reflected radio waves are received by the primary radiator 14 arranged on the focal line, whereby electromagnetic signals received are processed by a high frequency circuit 24 directly connected to the primary radiator 14. The antenna system is set, as shown in FIGS. 1A and 1C, such that the parabolic cylinder of the main reflector 12 stands vertically in order to prevent snow accretion when installed outside.

When an antenna system as outlined above is applied in a satellite communication apparatus for moving vehicles, it is desirable that the antenna system assume a low profile in order to preserve appearance, reduce crime risk, and reduce wind resistance when traveling. In this regard, the antenna system shown in FIG. 1A is inconvenient in that the larger the elevation angle of the artificial satellite, the more difficult it is to slim the antenna system. More specifically, the antenna system is constructed such that its directivity may be directed to a target satellite by relatively changing the difference between the height of the main reflector 12 and the height of the primary radiator 14. Therefore, the supporting arm 26 must be extended as the elevation angle of the artificial satellite is larger, which directly increases the entire height of the antenna system, being equal to at least (the total height of the height of the main reflector 12 plus the height of the supporting arm 26).

SUMMARY OF THE INVENTION

It is therefore an object of the present invention to provide an antenna system which is slimmer or reduced in height.

It is another object of the present invention to provide an antenna system for use in a tracking antenna system or the like which is simple in construction, inexpensive, and low-profile, without degradation of performance.

It is still another object of the present invention to provide an antenna system capable of transmitting and receiving circularly polarized waves.

To attain the above objects, an aspect of the invention provides an antenna system with the advantages described below.

First, according to one aspect, there is provided an antenna system comprising a ground plate; a primary radiator disposed on an upper surface of the ground plate; and a main reflector having a predetermined focal point or a predetermined focal line and standing on the upper surface of said ground plate such that said focal point or said focal line substantially corresponds to a location of said primary radiator.

According to another aspect, a polarizer is further provided for converting a radiated radio wave from a linearly polarized wave to a circularly polarized wave, or from a circularly polarized wave to a linearly polarized wave.

Said polarizer may be disposed on a mirror surface of said main reflector or between said main reflector and said primary radiator.

Alternatively, said polarizer may be disposed between said main reflector and an object to which the antenna system radiates radio waves or which radiates radio waves to the antenna system.

With this configuration, elements arranged on the ground plate are each designed to assume a suitable size or a suitable length and to be disposed at a suitable location on the ground plate, such that the primary radiator efficiently radiates radio waves only to the main reflector, or the main reflector radiates radio waves to the primary radiator, thereby achieving a highly efficient antenna system. Further, because the polarizer is provided, it is possible to transmit and receive circularly polarized waves, even when the primary radiator and the main reflector for transmitting/receiving linearly polarized waves are disposed on the ground plate. In addition, due to a mirror image effect obtained by the ground plate, the height of the antenna can be reduced to one half that of a comparable conventional antenna system. Also, only the surface of the ground plate in at least an area sufficient for achieving the mirror image effect need be composed of a conductive material. For example, the ground plate itself may be composed of a plastic material such as polycarbonate, and a thin conductive layer may be formed on part of its surface.

According to another aspect of the present invention, an antenna system comprises a ground plate; a primary radiator disposed on an upper surface of the ground plate; a main reflector having a predetermined focal point or a predetermined focal line and standing on the upper surface of said ground plate such that said focal point or said focal line substantially corresponds to a location of said primary radiator; and a polarizer composed of a plurality of grooves arranged at predetermined intervals and extending in the direction at approximately 45° with respect to the normal line of said ground plate, said polarizer being disposed on a mirror surface of said main reflector facing said primary radiator. Relative phases of two components of a radio wave orthogonal to each other are shifted from each other by said polarizer, such that conversion between linearly polarized waves and circularly polarized waves can be performed.

According to another aspect of present invention, the width D of said grooves formed on said main reflector is less than ½ a wavelength $\lambda 0$ of a radio wave to be used, and the height H of said grooves is an odd multiple of ⅛ said wavelength $\lambda 0$.

With the present invention, it is possible for a small-sized antenna system with a low profile to transmit and receive circularly polarized waves by providing grooves satisfying the above-described conditions on the main reflector. Because the dimensions for grooves satisfying configuration conditions can be simply calculated, the grooves can be designed easily and rapidly when, for example, a linear polarized antenna is used for a circular polarized antenna.

Further, the grooves can be easily formed by etching a previously prepared main reflector or by producing a main reflector using a specially designed mold.

In the grooves of the present invention, of the radio waves radiated from the primary radiator, a wave component orthogonal to the grooves is reflected from the bottom of the grooves and a wave component parallel to the grooves is reflected on the surface of the ridge formed between the grooves, to thereby create a phase difference 2H between the two components according to the height H of the grooves. Conversion between linear polarization and circular polarization is performed by setting the height H to a desired value, particularly setting the value such that 2H is ¼ the wavelength λ0 to be used.

According to another aspect of the present invention, the width D of said grooves formed on said main reflector is larger than ½ a wavelength λ0 of a radio wave to be used, and the width D and the height H of said grooves satisfy the following expression (1):

$$H = (2n-1) \times \frac{\lambda o}{8\left(1-\sqrt{1-\left(\frac{\lambda o}{2D}\right)^2}\right)} \quad (1)$$

$$n = 1, 2, \ldots$$

Conversion between linear polarization and circular polarization is also possible when the grooves satisfy the above conditions in the expression (1), and therefore a small and low-profile antenna system capable of transmission and reception of circularly polarized waves can be obtained. Further, because a density of the grooves formed on one main surface is low due to a relatively wide width of the grooves, the grooves can be easily formed.

In the grooves defined by the above expression (1), in a radio wave incoming to the main reflector, the wavelength of a component parallel to the grooves expands when transmitted from the surface of the ridges formed between the grooves to the bottom of the grooves, while the wavelength of a component orthogonal to the grooves does not change, thereby creating a phase difference between these components. Accordingly, by setting the phase difference to ¼ the wavelength λ0 while the radio wave is transmitted between the grooves due to reflection by the mirror surface, conversion between linear polarization and circular polarization can be performed.

According to another aspect of the present invention, an antenna system comprises a ground plate; a primary radiator disposed on an upper surface of said ground plate; a main reflector having a predetermined focal point or a predetermined focal line and standing on the upper surface of said ground plate such that said focal point or said focal line substantially corresponds to a location of said primary radiator; and a linear conductor element composed of a plurality of linear conductors arranged at predetermined intervals and extending in the direction at approximately 45° with respect to the normal line of said ground plate, said linear conductor element being disposed on a mirror surface of said main reflector facing said primary radiator, wherein relative phases of two components of a radio wave orthogonal to each other are shifted from each other by a surface of said linear conductor element and the mirror surface of said main reflector for converting linearly polarized waves and circularly polarized waves.

Further, in the above-described antenna system, the interval D between said linear conductors is smaller than ½ a wavelength λ0 of radio waves to be used, and said linear conductor element is disposed in front of said main reflector such that the distance H between the surface of said linear conductor element and the mirror surface of said main reflector is an odd multiple of ⅛ said wavelength λ0.

For an incoming radio wave, a component parallel to the direction that the conductors extend is reflected on the surface of the above-described linear conductor element, while a component orthogonal to the linear conductors is not reflected by the conductors, but is reflected on the mirror surface of the main reflector. As a result, a phase difference 2H according to the distance between the surface of the linear conductor element and the mirror surface of the main reflector is generated between these two components of the radio wave. This phase difference is set to be ¼ the wavelength λ0 of the radio wave to be used, such that conversion between linear polarization and circular polarization can be performed. Because the linear conductor element can be separated from the main reflector, a circular polarized antenna system can be obtained from a linear polarized antenna system by simply disposing the linear conductor element in front of the main surface.

According to still another aspect of the present invention, an antenna system comprises a ground plate; a primary radiator disposed on an upper surface of said ground plate; a main reflector having a predetermined focal point or a predetermined focal line and standing on the upper surface of said ground plate such that said focal point or said focal line substantially corresponds to a location of said primary radiator; and a polarizer composed of meander-line conductors for converting linearly polarized waves and circularly polarized waves, said polarizer being disposed between said main reflector and said primary radiator, or between said main reflector and an object to which the antenna system radiates radio waves or which radiates radio waves to the antenna system.

The polarizer thus disposed can also convert linear polarization and circular polarization, and therefore a circular polarized antenna which is small and of a low profile can be obtained using a primary radiator for transmitting and receiving linearly polarized waves.

Further, in any of the antenna systems described above, said primary radiator may include a feed probe disposed so as to protrude from the upper surface of said ground plate; and a sub-reflector facing said main reflector via said feed probe and standing in the vicinity of said feed probe on the upper surface of said ground plate.

With such a configuration, the sub-reflector is designed to be of a suitable size or length and to be arranged at a suitable location on the ground plate, such that it can efficiently radiate radio waves to the main reflector, or the main reflector can radiate radio waves to the sub-reflector. As a result, impedance can be matched in a wide frequency band, thereby achieving a highly efficient antenna system.

Further, in the above-described antenna system, the feed probe may be a sleeve dipole antenna element formed by a coaxial line comprising a central conductor and an external conductor, the external conductor having a sleeve thereof folded by a length equal to approximately ¼ a wavelength, at the end of the coaxial line, the central conductor having a linear conductor extending therefrom by a length equal to approximately ¼ the wavelength away from the end.

With such a configuration, when the sleeve dipole antenna element and the ground plate are used in combination with the feed point of an antenna element being positioned above the upper surface of the ground plate, characteristics corresponding to those obtained by a two-element linear array used as a primary radiator can be obtained thorough the mirror image effect of the ground plate, and the directivity of the antenna in the horizontal direction can be enhanced. As a result, especially when the height of the main reflector is reduced, unnecessary radio waves radiated over the main reflector can be reduced, leading again to a highly efficient antenna system.

According to still another aspect of the present invention, an antenna system comprises a ground plate; a primary radiator disposed on an upper surface of said ground plate; and a main reflector having a predetermined focal point or a predetermined focal line and standing on the upper surface of said ground plate such that said focal point or said focal line substantially corresponds to a location of said primary radiator; wherein said primary radiator includes a feed probe disposed on said ground plate so as to protrude from the upper surface thereof, a feed probe external conductor disposed on the ground plate so as to surround said feed probe and electrically connected to said ground plate, a feed slot formed in said feed probe external conductor in a portion facing said main reflector, and an antenna element disposed in the vicinity of said feed slot and electromagnetically coupled with said feed probe.

When a circular polarized radiation element is employed as this antenna element, an antenna system capable of transmission and reception of circularly polarized waves can be implemented without the need for providing a separate polarizer.

Further, when the feed probe, the feed probe external conductor, the feed slot and the antenna element which together form the primary radiator are used in combination with the ground plate, with the feed point of the feed probe being positioned above the upper surface of the ground plate, the same characteristics as that obtained by a two-element linear array used as the primary radiator can be obtained thorough the mirror image effect of the ground plate, whereby the directivity of the antenna in the horizontal direction can be enhanced. As a result, especially when the height of the main reflector is reduced, unnecessary radio waves radiated over the main reflector can be reduced, leading to high efficiency of the antenna system.

According to another aspect of the present invention, in the above antenna system, the ground plate is disposed on a base stand and is rotatable with respect to said base stand around the feed probe so as not to contact with said feed probe.

Thus, because the feed prove does not contact with the ground plate, when, for example, the ground plate is turned around the feed probe serving as the central axis in the azimuth direction, it is not necessary to rotate a distribution line for feeding electric power to the feed probe. This eliminates the need for components, such as a rotary joint, required for accommodating motion of the feed probe to the rotary motion, leading to reduction in cost of the antenna system. Also, because a high frequency circuit to be mounted on the ground plate is not necessary, a driving mechanism for rotating the ground plate can be simplified and downsized. Still further, by setting the directivity in the elevation angle of the antenna block while determining an installation angle θ of the main reflector to a desired value, a separate mechanism for adjusting the elevation angle can be eliminated, which is advantageous in slimming the antenna system.

Further, in the present invention, the hole formed in the ground plate may have a periphery thereof provided with a circular conductor member extending from the reflection surface to the lower surface by a length equal to approximately ¼ a wavelength, the circular conductor member having a hollow portion formed therein, the feed probe being inserted into the hollow portion. By providing the conductive inner surface at the hole area or the circular conductor member, even if the feed probe and the ground plate are kept from contact with each other, radio waves can be prevented from leaking to the lower surface of the ground plate, to thereby improve the efficiency of the antenna system.

In any of the above-described antenna systems of the present invention, the main reflector stands on the upper surface of the ground plate at an angle of installation depending on an elevation angle and in a direction that receives radio waves or in a direction that radiates radio waves. This arrangement allows the directivity of the antenna in the elevation angle direction to be adjusted by determining the installation angle θ of the main reflector with respect to the ground plate to a desired value. As a result, the thickness of the antenna system, which is determined by the height of the main reflector, can be slimmed down, and to therefore a lower-profile antenna system can be implemented. In addition, it is not necessary to change the position of the whole antenna system so as to adjust the elevation angle, leading to a system with a lower profile. Still further, when the width of the directional beams is expanded in the direction of the elevation angle by setting the height of the main reflector to be lower, tracking of an artificial satellite in the direction of the elevation angle need not be performed by the antenna system. On the other hand, when the main reflector is formed of a belt-type offset parabola having a focal point at a location of the feed probe, the width of directional beams in the plane at the elevation angle can be narrowed, to thereby obtain higher peak gain.

According to still another aspect of the present invention, an antenna system comprises a ground plate; a primary radiator disposed on an upper surface of said ground plate; and a main reflector having a predetermined focal point or a predetermined focal line and standing on the upper surface of said ground plate at an angle according to an elevation angle in a direction that receives radio waves or a direction that radiates radio waves, such that said focal point or said focal line substantially corresponds to a location of said primary radiator; wherein said main reflector includes a plurality of reflector regions having different inclination angles with respect to said ground plate.

According to still another aspect of the present invention, a main reflector as described above is combined with one or more of the above-described antenna systems.

Due to interference of the directivities of a plurality of reflector regions having different inclination, the above-described main reflector can provide a combined directivity in the elevation angle of the antenna, which results in the directivity of the antenna system, which is wide in range and has a desired gain.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENTS

The present invention will now be described in detail with reference to the drawings illustrating various aspects of the preferred embodiment.

[Aspect 1]

Figure 2A:
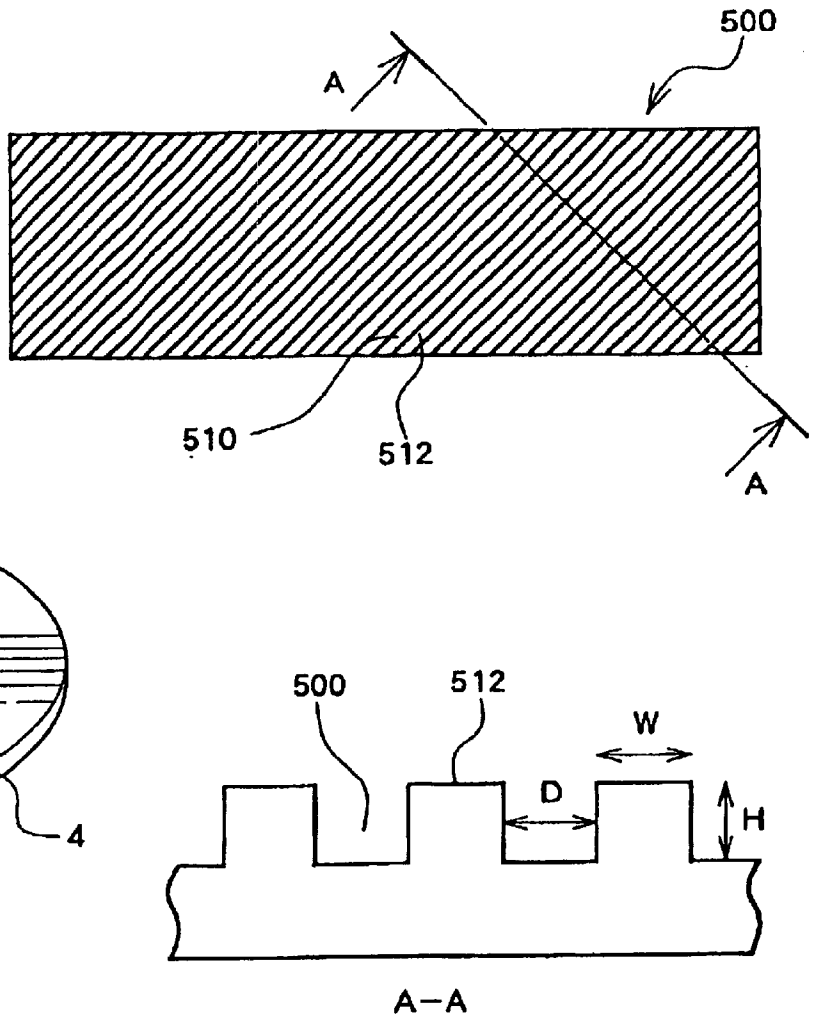
FIG. 2A is a cross sectional view showing the configuration of a polarizer taken along line A—A of FIG. 2.
Figure 2:
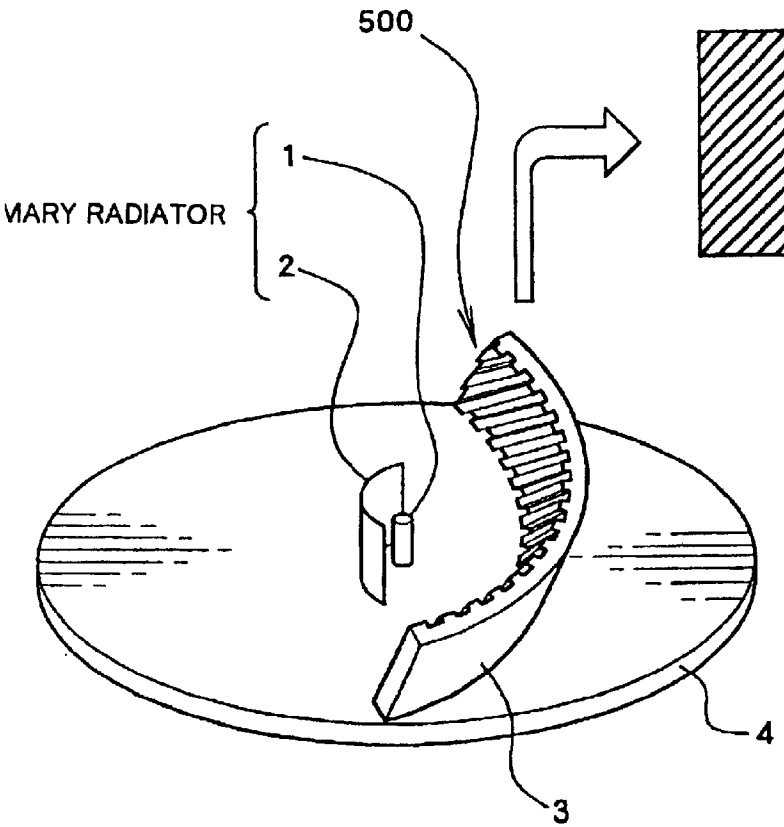
FIG. 2 is a perspective view showing the configuration of an antenna system according to Aspect 1 of the present invention.
Figure 3:
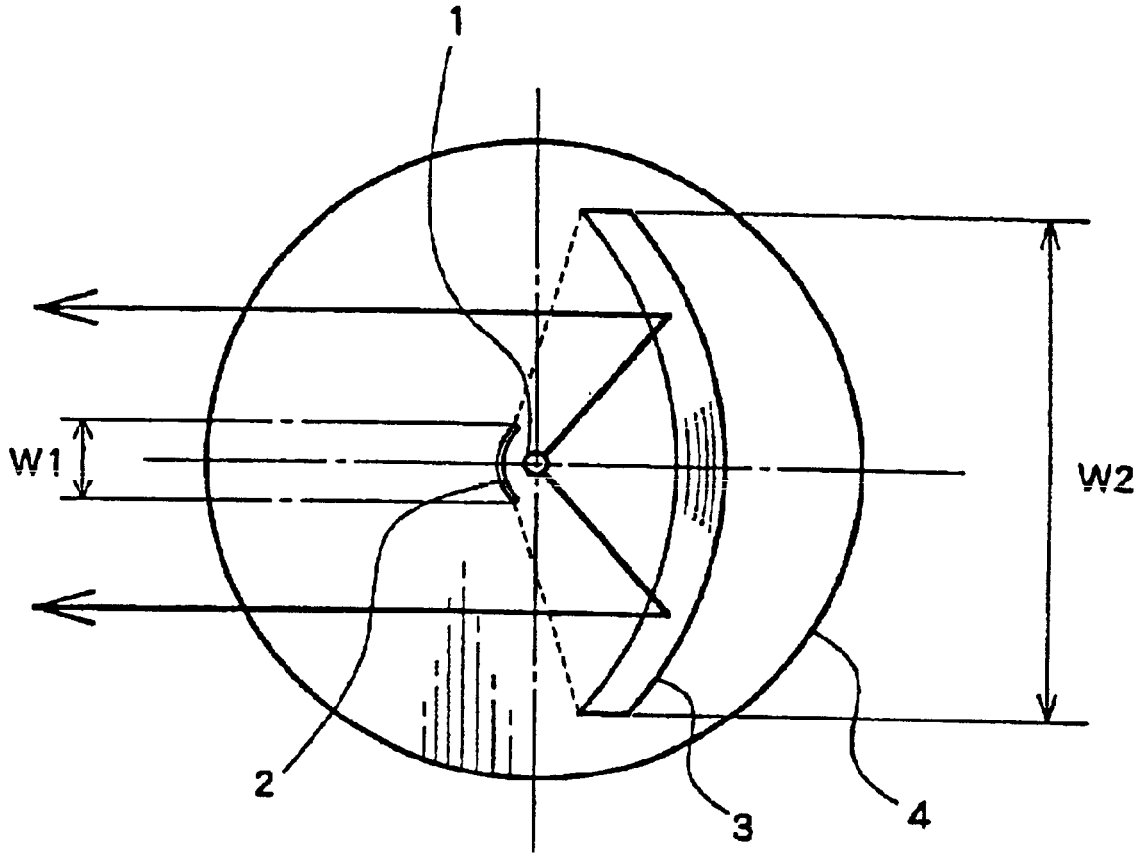
FIG. 3 is a plan view showing the configuration of the antenna system according to Aspect 1 of the present invention.
Figure 4A:
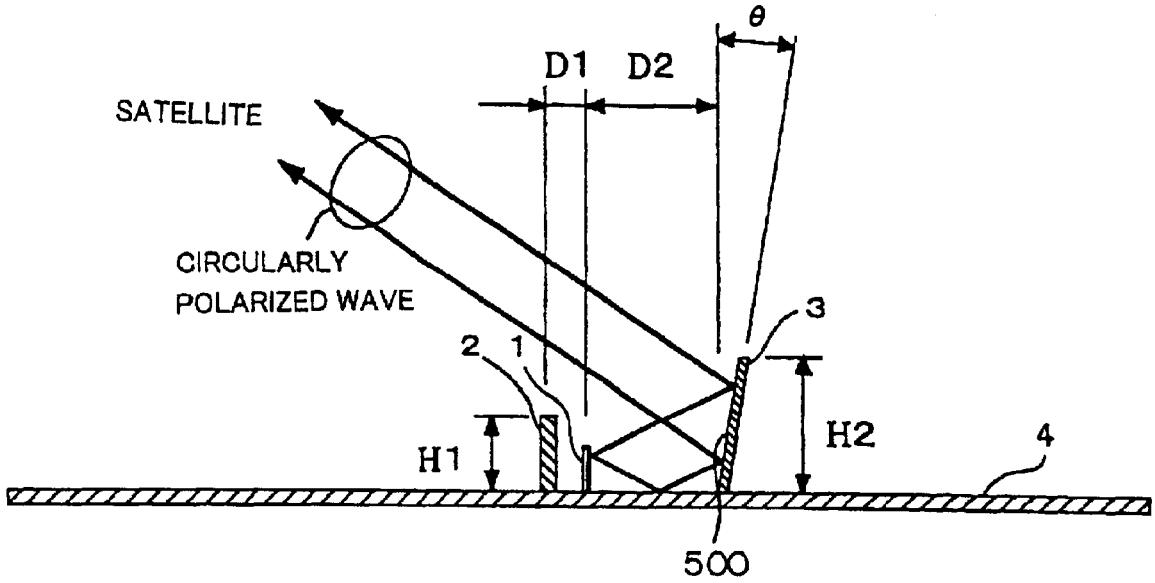
FIGS. 4A and 4B are views for explaining the operation principle of the antenna system according to Aspect 1 of the present invention.
Figure 4B:
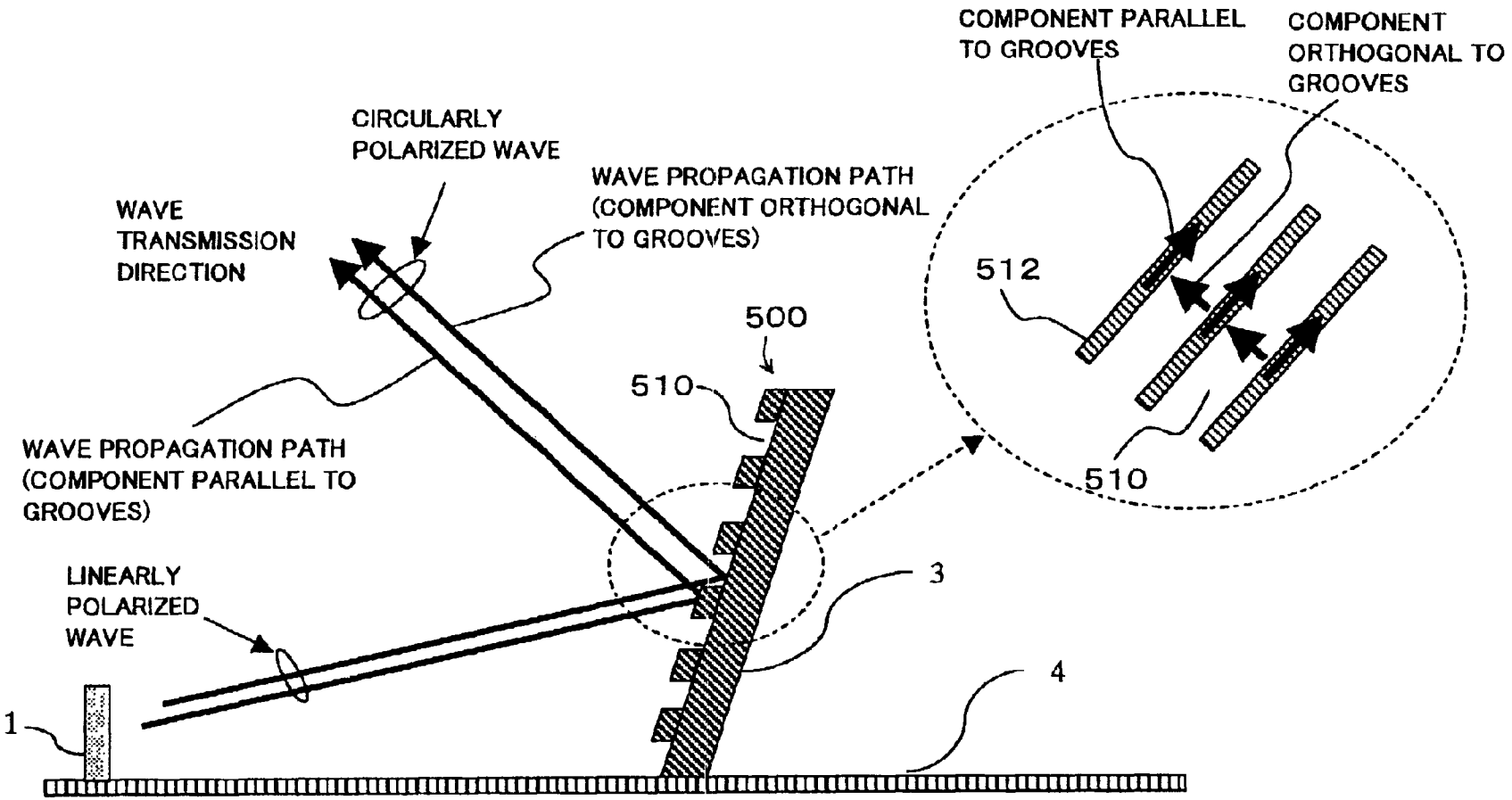

FIG. 2 schematically illustrates the configuration of a circular polarized antenna system according to an Aspect 1 of the preferred embodiment of the present invention. FIG. 2A is a cross sectional view of a polarizer (polarization converter) 500 of the antenna system of FIG. 2, while FIG. 3 is a plan view of the antenna system. FIGS. 4A and 4B are cross sectional views of the significant portions of the antenna system. The antenna system is applied, for example, to an in-vehicle satellite tracking antenna which functions both as a transmitting antenna and a receiving antenna. In the following description, a transmission antenna system will be described for simplicity of description.

As shown in the figures, the antenna system comprises a ground plate 4 having an upper surface which serves as a reflection surface, a primary radiator (as will be described in detail) and a main reflector 3 disposed on the upper surface of the ground plate 4. The primary radiator is composed of a feed probe 1 and a sub-reflector 2 and is capable of radiating (transmitting and receiving) electric waves in free space. The reflection surface of the ground plate 4, together with the feed probe 1, forms a part of the primary radiator. The antenna system in Aspect 1 also comprises a polarizer 500 on the reflection surface of the main reflector 3 for converting linearly polarized waves radiated by the primary radiator into circularly polarized waves.

The feed probe 1 is inserted into the ground plate 4 having a disc shape, from a rear (lower) surface of the ground plate 4, to thereby protrude from the reflection (upper) surface of the ground plate 4. The sub-reflector 2 and the main reflector 3 are disposed on the reflection surface of the ground plate 4 so as to face each other across the feed probe 1. The main reflector 3 is a belt-type parabolic cylinder having a predetermined focal line, a parabolic horizontal cross section, and a linear vertical cross section. The main reflector 3 is spaced a distance D2 away from the feed probe 1 so that the feed probe 1 is placed on the focal line. The sub-reflector 2 forms a semicylinder and is installed in the vicinity of the feed probe 1 such that mirror surfaces of the main reflector 3 and the sub-reflector 2 face each other across the feed probe 1. The sub-reflector 2 is spaced a distance D1 away from the feed probe 1.

In the present aspect, a monopole antenna, which is omnidirectional in a horizontal plane, is composed by inserting the linear feed probe 1 into the ground plate 4 from the rear side thereof. Therefore, by arranging the sub-reflector 2 close to the feed probe 1 such that the sub-reflector 2 is opposed to the main reflector 3 across the feed probe 1, and by optimizing the sub-reflector 2 with respect to a width W1 thereof in the horizontal direction (see FIG. 3) and with respect to a height H1 in the vertical direction (see FIG. 4A), radio waves transmitted from the feed probe 1 to the sub-reflector 2 are reflected by the sub-reflector 2, whereby the radio waves can be efficiently radiated to the main reflector 3. Note that FIG. 4A illustrates a mirror image effect achieved by the upper surface of the ground plate 4 serving as a reflection surface.

The primary radiator in the present aspect is constructed such that the feed probe 1 has a length equal to ¼ the wavelength which corresponds to the resonance wavelength, and by adjusting the distance D1 between the feed probe and the sub-reflector 2, impedance can be matched over a wide band.

The polarizer 500 will now be described. As already described, the linear feed probe 1 directly or indirectly radiates linearly polarized waves to the main reflector 3. In Aspect 1, in order to utilize such a linear polarized radiator to obtain a circular polarized antenna system, the antenna system further comprises the polarizer 500 for conversion between linear polarization and circular polarization, besides the ground plate 4, the primary radiator and the main reflector 3. More specifically, the polarizer 500 converts linearly polarized waves into circularly polarized waves at the time of wave transmission and vise versa at the time of wave reception.

In the present Aspect, the polarizer 500, which performs conversion between linearly polarized waves and circularly polarized waves by changing relative phases of two components of a radio wave orthogonal to each other, is composed of a plurality of striped grooves formed on the mirror surface of the main reflector 3 and ridges 512 formed between the grooves. Each of the grooves 510 extends at an angle of approximately 45° with regard to the normal line of the ground plate 4. If the wavelength of a radio wave to be used (a propagation wavelength in free space at a frequency to be used) is $\lambda 0$, the height H of the groove 510 is an odd multiple of $\frac{1}{8}\lambda 0$ while the width D of the groove 510 is less than $\frac{1}{2}\lambda 0$. Although the width W of the ridge (convex) between the grooves is not specifically limited, the smaller the better, and may be $0.1\lambda 0$, for example.

Referring now to FIG. 4B, the operation for wave radiation of the antenna system when converting linear polarization to circular polarization will be described. For wave transmission, for example, a linearly polarized wave radiated from the feed probe 1 is reflected by the main reflector 3 so that it is radiated in the wave transmission direction. However, because the radio wave radiated from the feed probe 1 which stands in the normal line direction of the ground plate 4 has only an electric field component normal to the ground plate 4, even after being reflected by the main reflector 3, the antenna system can transmit only linearly polarized waves. To address this problem, in the present Aspect, the grooves 510 are formed on the reflection surface of the main reflector 3 at an angle of approximately 45° with respect to the normal line of the ground plate 4. Accordingly, when a linearly polarized wave composed of a component extending in the direction of the groove 510 and a component orthogonal to the foregoing component enters the reflection surface of the main reflector 3, the component parallel to the groove 510 is reflected on the ridge portion of the main reflector 3 while the component orthogonal to the groove 510 is reflected on the bottom portion of the groove. This results in a difference 2H in paths according to the height H of the groove 510, between the two electric field components orthogonal to each other, thereby generating a relative difference in phases to be propagated.

In the present Aspect, the height H of the groove 510 is determined so that the path difference 2H is ¼ the wavelength $\lambda 0$ to be used, namely 90°, and therefore a linearly polarized wave is automatically converted into a circularly polarized wave when the radio wave from the primary radiator is reflected by the main reflector 3. For conversion from linear polarization to circular polarization, the height H of the groove 510 must be an odd multiple of approximately ⅛ the wavelength $\lambda 0$ to be used, as already described. Also, the width D of the groove 510 must be less than ½ the wavelength $\lambda 0$ in order to prevent an electric field component parallel to the groove 510 of radio waves entering the main reflector 3 from being entered into the groove.

For wave reception, as long as incoming wave is circularly polarized, it is possible to perform the operation opposite to that described above to shift the relative phases of two components of the circularly polarized wave orthogonal to each other, when the incoming wave is reflected by the main reflector 3 toward the primary radiator, thereby converting a circularly polarized wave into a linearly polarized wave. Thus, efficient wave transmission and reception can be performed, even when the feed probe employed can receive only an electric field component in the normal line (vertical) direction of the ground plate. Accordingly, the antenna system of Aspect 1 enables transmission/reception of circularly polarized waves with a simple structure in which above-mentioned grooves are formed in the main reflector.

In the example antenna system of Aspect 1, the diameter of the ground plate is sufficiently large with respect to the wavelength $\lambda 0$, and the main reflector is arranged on the ground plate. Therefore, scattering of radio waves caused by the edge of the ground plate 4 can be eliminated, which can lower the elevation angle of directional beams of the primary radiator. As a result, radiation of radio waves over the main reflector 3 is reduced so that, even if the height of the main reflector is reduced to give the antenna system a lower profile, degradation in antenna efficiency can be prevented.

In the present Aspect 1, it is sufficient if at least a region of the upper surface of the ground plate 4 surrounded by the mirror surface of the sub-reflector 2 and the mirror surface of the main reflector 3 facing the same, indicated by the dotted lines in FIG. 3, functions as the reflection surface. In order to prevent scattering of radio waves, however, it is preferable that an area outside the area defined by the dotted lines connecting ends of the sub-reflector 2 and the main reflector 3 as shown in FIG. 3, should function as the reflection surface, to thereby realize mirror image effects. Further, the ground plate may be composed of a conductive plastic material. In this case, the mirror image effect can be obtained without providing a separate thin conductive layer on the upper surface of the ground plate.

Figure 1A:
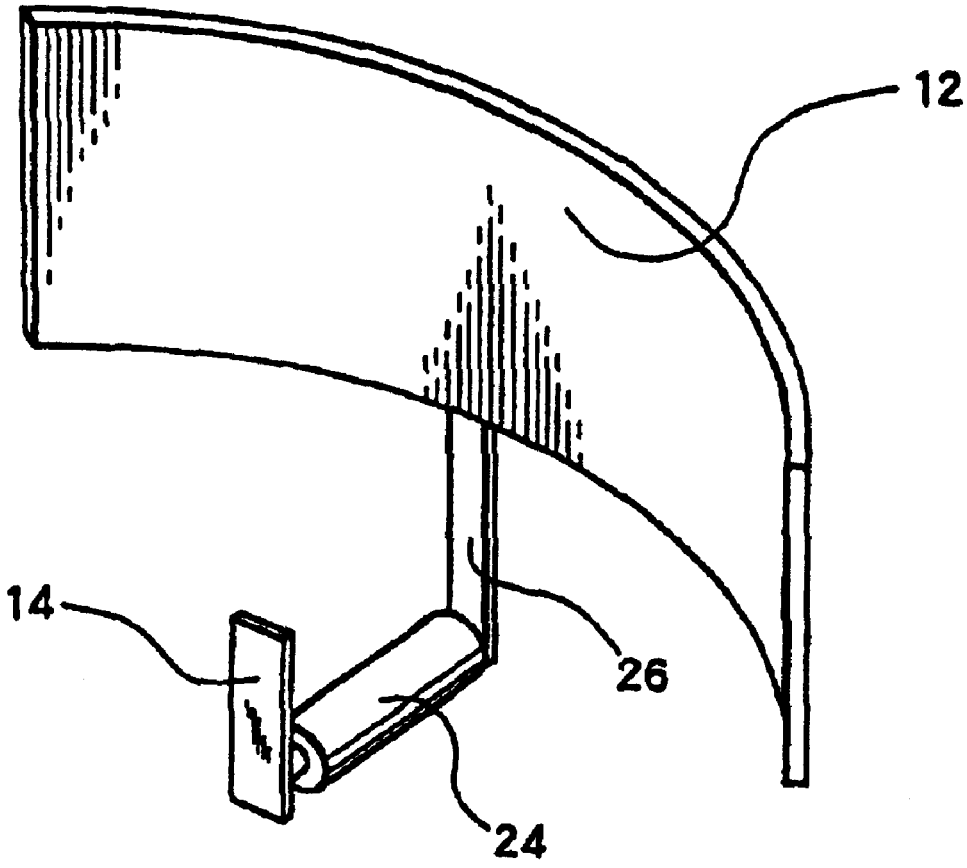
FIG. 1A PRIOR ART
FIG. 1A is a perspective view showing the configuration of a conventional antenna system.

The main reflector can be inclined at an optional installation angle θ with respect to the normal line of the ground plate 4. By virtue of this inclination, even when the antenna system does not assume a high profile, the installation angle θ can be set according to the elevation angle of the artificial satellite (the elevation angle in a direction that receives radio waves or a direction that radiates radio waves) so as to easily focus radiation in the direction of the artificial satellites. In Aspect 1, the total height of the antenna system is almost equal to the height of the main reflector 3. While in the conventional antenna system as shown in FIG. 1A, increase in the elevation angle of directional beams inevitably lead to increase in the height of the antenna, according to the antenna system in Aspect 1, increase in the elevation angle of directional beams can be dealt with merely by adjusting the installation angle θ of the main reflector 3, and therefore the height of the antenna need not be increased. In addition, where θ=0, if the height of the antenna is reduced to even one half of the height of the system shown in FIG. 1A, the same directivity can be obtained by the mirror image effect due to the ground plate. Therefore, by use of the present invention an extremely low profile antenna system can be achieved.

Gain of the antenna system and directional beam width can be set to desired values by adjusting, respectively, the width W1 and the height H1 of the sub-reflector 2 or a width W2 and a height H2 of the main reflector 3. When the height H2 of the main reflector 3 is low, the directional beam width in a plane at the elevation angle is expanded, resulting in decreased gain. To overcome this disadvantage, according to the antenna system in Aspect 1, as shown in FIG. 3, the main reflector 3 is formed as a horizontally parabolic cylinder to thereby direct horizontally spread directional beams. As a result, even if an aperture area is reduced due to the low profile of the antenna system, decrease in the gain can be suppressed.

With the above configuration, the antenna system in Aspect 1 can be configured with a low profile, but with excellent performance and only slight decrease in gain despite that low profile. As a result, a low-profile antenna suitable for installation in vehicles can be realized. Further, the antenna system in Aspect 1 enables transmission and reception of circularly polarized waves despite the primary radiator capable of transmission and reception only of linearly polarized waves using a very simple process of providing predetermined grooves in the main reflector.

Figure 5:
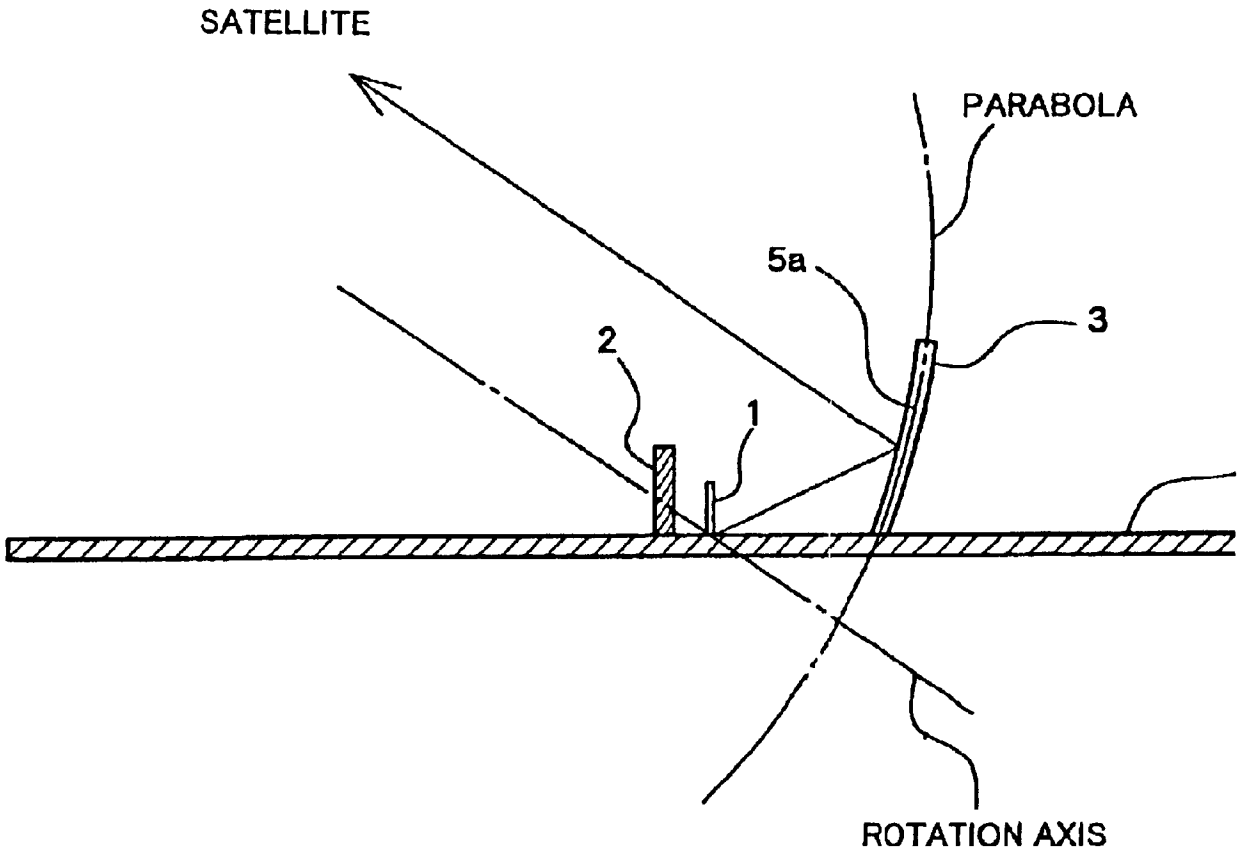
FIG. 5 is a cross sectional view schematically showing the configuration of an antenna system according to a variation of Aspect 1.

The above described antenna system employs the main reflector which is horizontally parabolic and vertically straight. Alternatively, the main reflector 3 may be formed by a belt-type rotational parabolic cylinder (offset parabola), as shown in FIG. 5, which has a focal point at a location of the feed probe and a rotational axis indicated by the chain line in the figure. When the wave source of the primary radiator can be practically modeled as a point source, high peak gain can be obtained by the main reflector 3 shown in FIG. 5 than by the parabolic main reflector 3 shown in FIG. 2, thereby enhancing sensitivity.

[Aspect 1-1]

Figure 6:
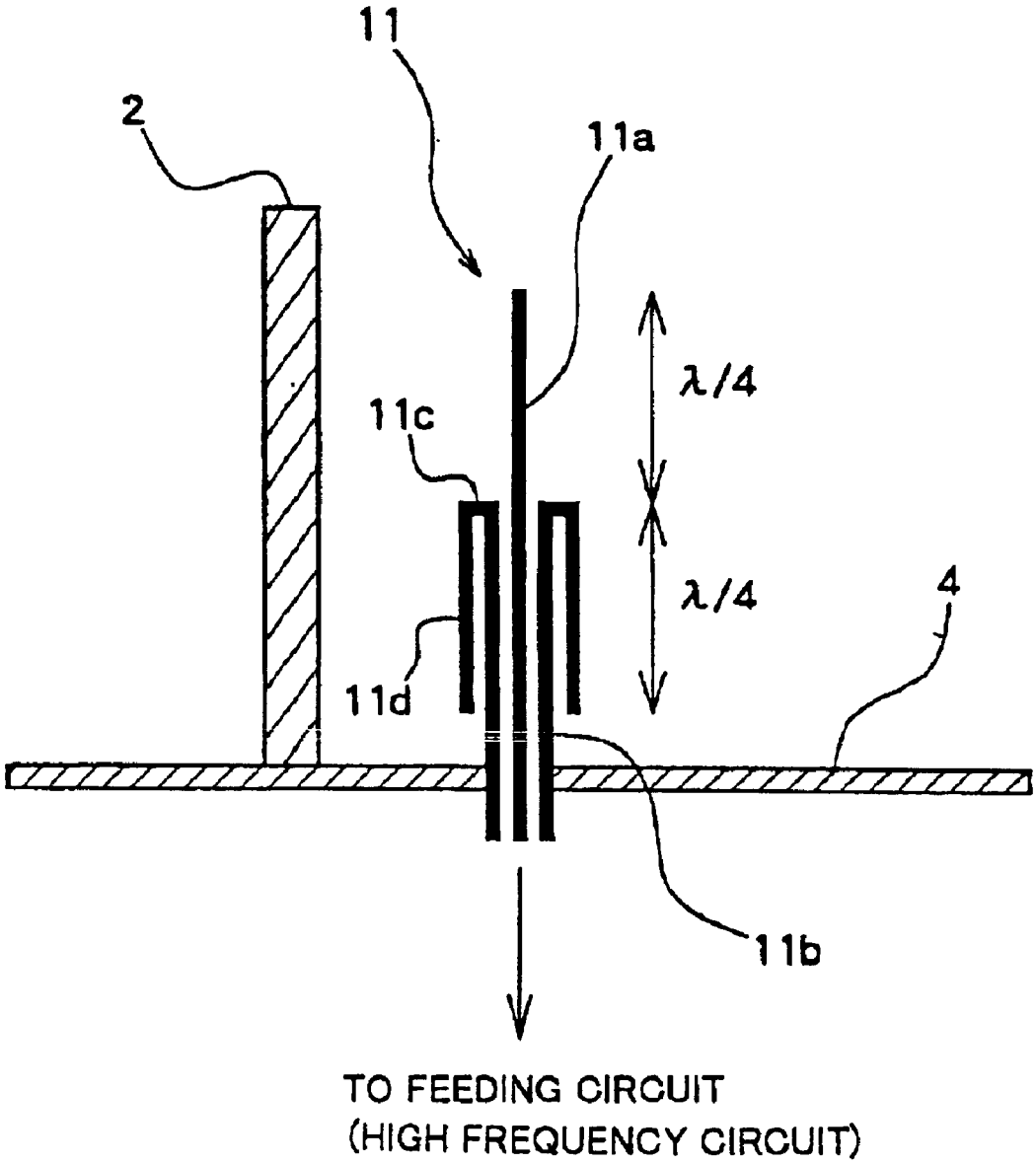
FIG. 6 is a cross sectional view showing the detailed configuration of the feeding block of an antenna system according to Aspect 1-1 of the present invention.

According to an antenna system in Aspect 1-1 of the preferred embodiment of the present invention, a sleeve dipole antenna element 11 as shown in FIG. 6 is employed as a feed probe in place of the feed probe 1 of Aspect 1. The feed probe 11, formed by a coaxial line, is comprised of a central conductor 11*a* and an external conductor 11*b*. At an end of the coaxial line, a sleeve 11*d* of the external conductor 11*b* is folded by approximately ¼ the wavelength λ to be used, while a linear conductor extending from the central conductor 11*a* protrudes from the end by approximately ¼ the wavelength A to be used. The linear conductor may be the extended central conductor itself, or another conductor connected to the central conductor. With this configuration, the location of the sleeve dipole antenna element 11 (feed point) with respect to the ground plate 4 and the sub-reflector 2 is appropriately arranged, such that impedance can be matched in a wide frequency band, similarly to the antenna system in Aspect 1. The configuration and arrangement of elements (the main reflector and the polarizer) other than the primary radiator are identical to Aspect 1.

In the monopole primary radiator equipped with the ground plate 4 as in Aspect 1, the width of directional beam is relatively wide. Further, when the height of the main reflector 3 is not great, radiation of radio waves over the main reflector 3 cannot be completely prevented, and antenna efficiency is slightly degraded. A discrete sleeve dipole antenna, on the other hand, works without the ground plate, with the same directivity as that of the monopole antenna equipped with the gourd plate. Therefore, if the sleeve dipole antenna element 11 and the ground plate 4 are used in combination, as shown in FIG. 6, and the feed point of the antenna element is upwardly separated from the ground plate 4, the same characteristics as that obtained by a two-element linear array used as the primary radiator can be obtained due to the mirror image effect obtained by the ground plate 4. As a result, the directivity of the antenna in the horizontal direction can be improved. The feed point of the sleeve dipole antenna element is set to a location (11*c*) at which the sleeve 11*d* of the coaxial line is folded.

In Aspect 1-1, the combination of the antenna element 11 and the ground plate 4 enables intensification of the directivity in the horizontal direction. Accordingly, when the main reflector with a reduced height (H2) is employed, the antenna system in Aspect 1-1 can obtain higher gain than the antenna system in Aspect 1, provided that conditions other than the height (H2) are the same. Therefore, the antenna system in the present aspect can be a more preferable low-profile antenna system.

[Aspect 1-2]

According to Aspect 1-2 of the present invention, the circular polarized antenna system as described in the foregoing Aspect 1 is employed as an antenna block which is controllable in a rotatable manner with respect to an azimuth, such that it is applicable to a tracking antenna system, such as an in-vehicle satellite tracking antenna, which is small in size with a power saving function, in addition to being low-profile and low-cost.

Figure 7:
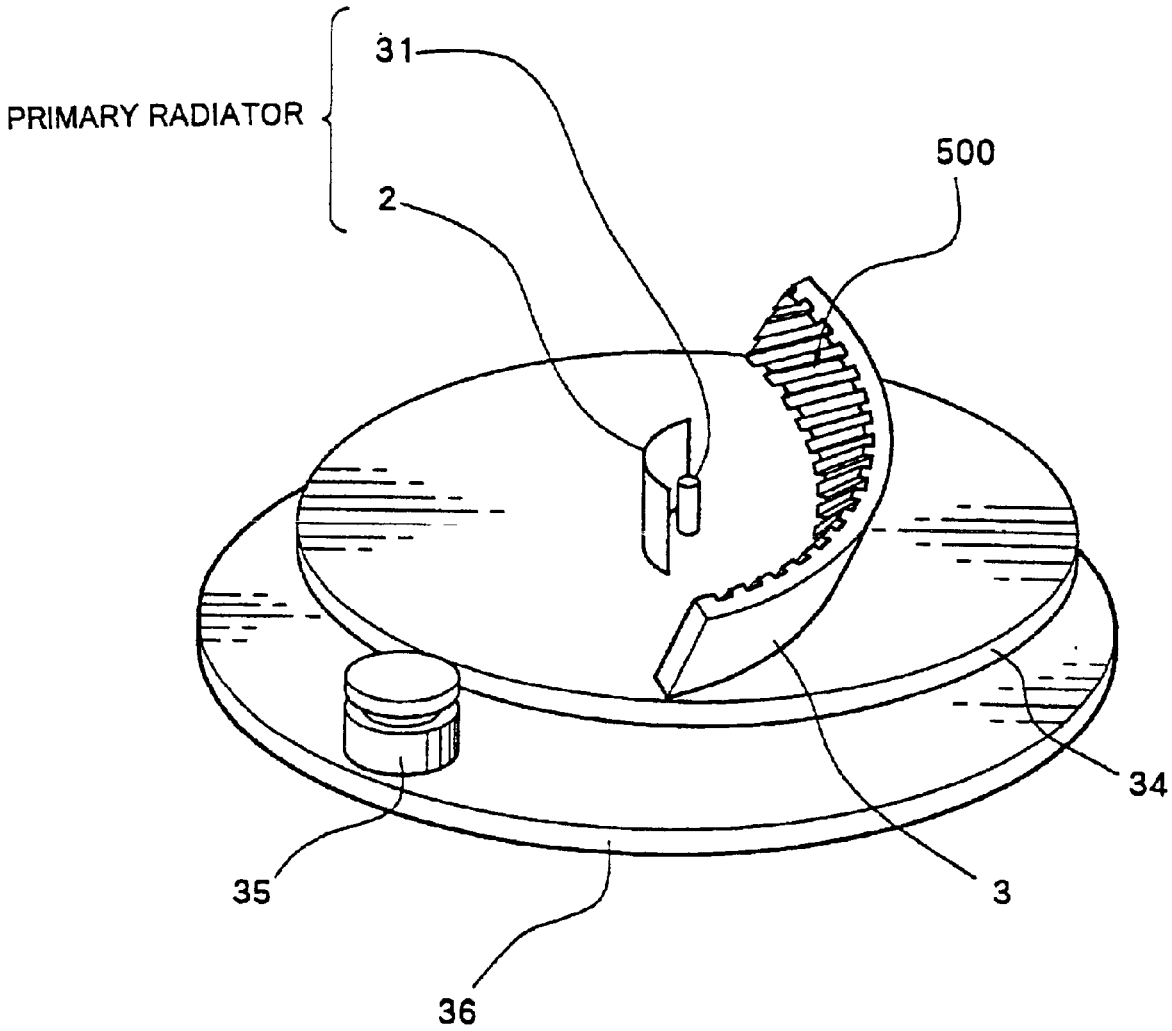
FIG. 7 is a perspective view showing the configuration of an antenna system according to Aspect 1-2 of the present invention.
Figure 8:
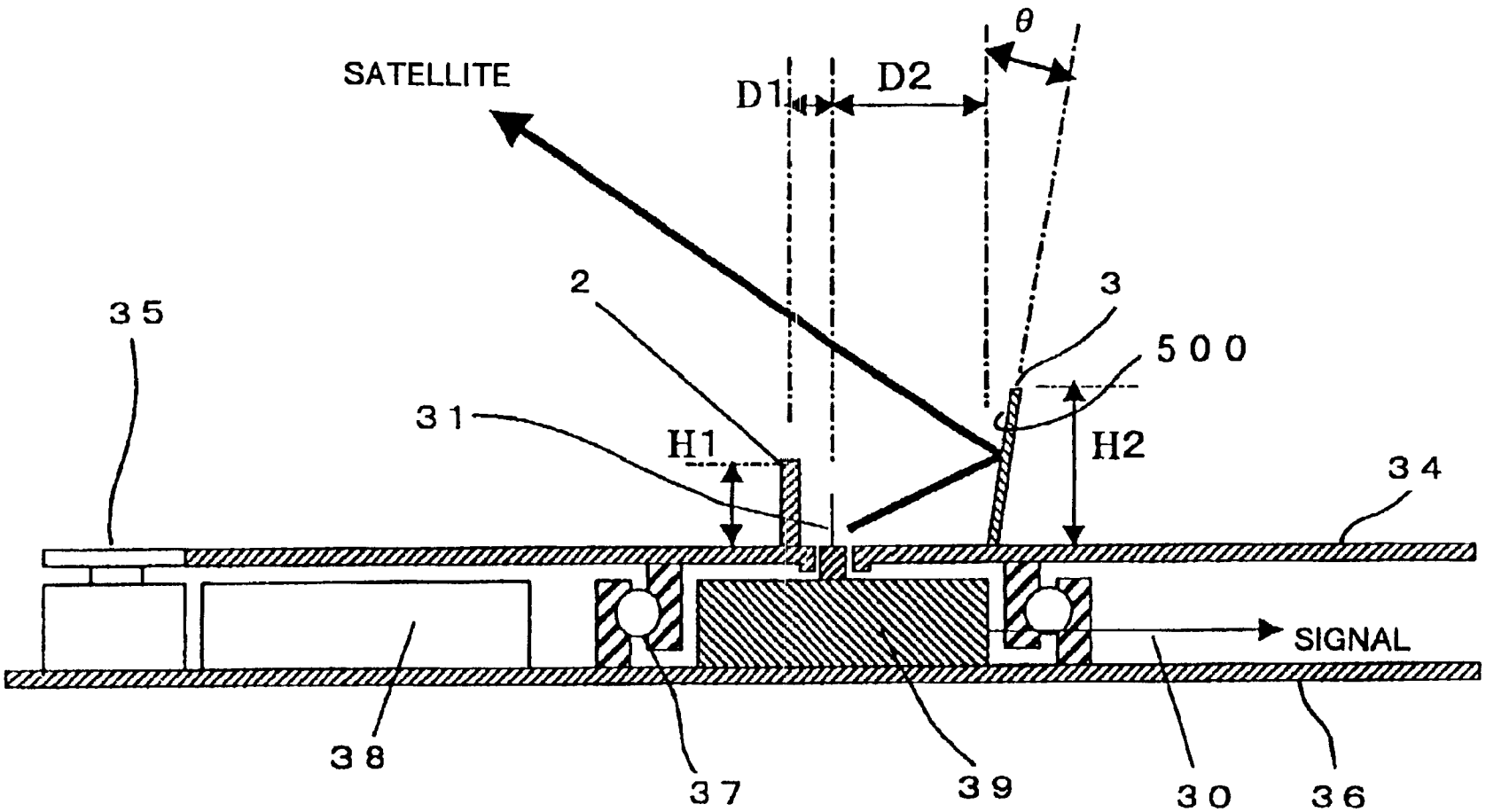
FIG. 8 is a cross sectional view showing the detailed configuration of the antenna system of FIG. 7.

FIG. 7 conceptually depicts the tracking antenna system, while FIG. 8 is a schematic cross sectional view of the system shown in FIG. 7. Referring to these figures, on the upper surface (reflection surface) of a ground plate 34 forming the antenna block are arranged the sub-reflector 2 and the main reflector 3 having the circular polarizer 500, as in Aspect 1. A feed probe 31 is connected to a high frequency circuit 39 which is secured on a base stand 36. Further, in the ground plate 34 is formed a hole into which the feed probe 31 is inserted from the lower surface of the ground plate 34 so that the feed probe 31 protrudes from the upper surface of the ground plate 34 without being in contact with the ground plate 34.

In the present aspect, the ground plate 34 also functions as a turntable for rotating the antenna system to a desired azimuth, and is disposed on the base stand 36 in a freely rotatable manner around the feed probe 31 via a bearing 37. Further, on the base stand 36, an azimuth tracking motor 35 is disposed at a periphery of the disc-type ground plate 34 for transferring drive force thereof to the periphery of the ground plate 34, to thereby drive the ground plate 34 for rotation. The motor 35 is driven by an azimuth tracking motor driving circuit 38 which is also arranged on the base stand 36 in a space between the base stand 36 and the ground plate 34.

Figure 9:
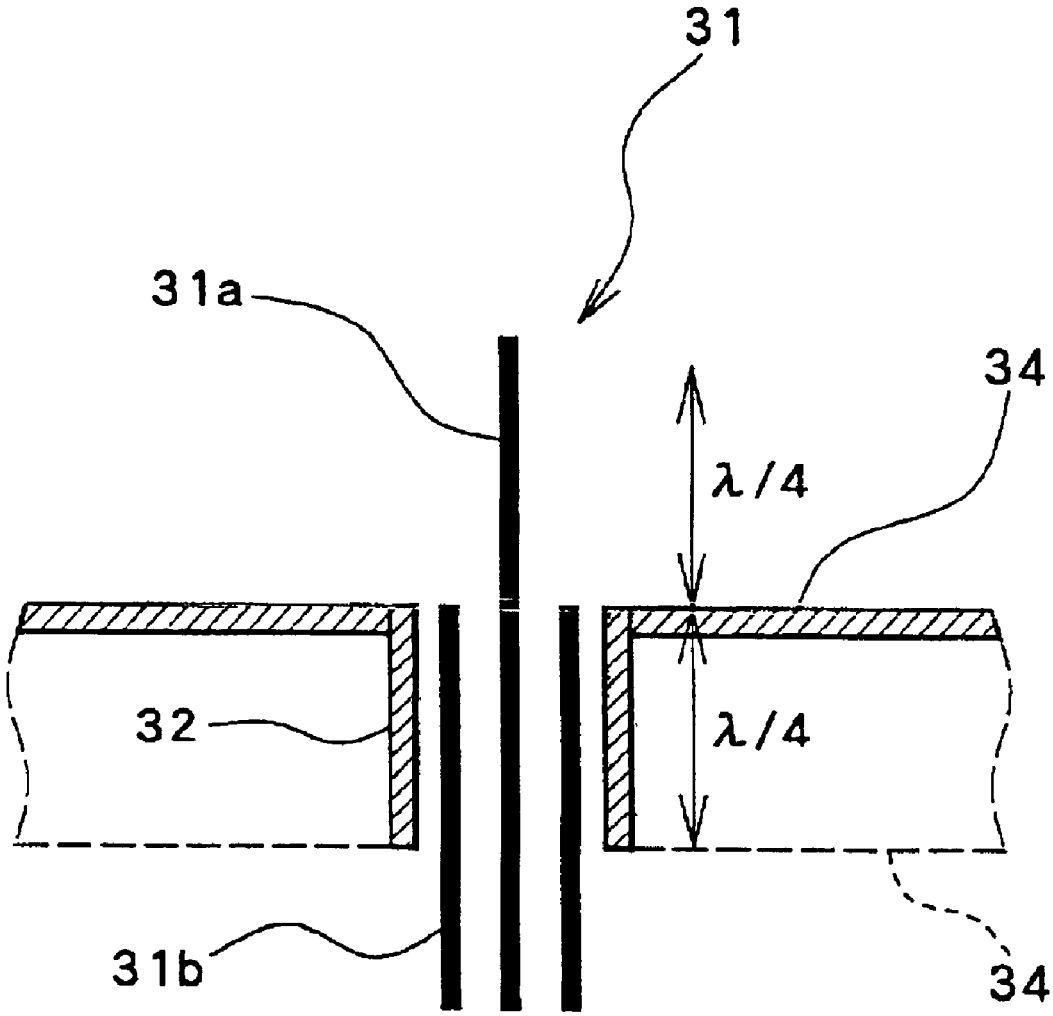
FIG. 9 is a cross sectional view showing the detailed configuration of the feeding block of the antenna system of FIG. 7.

FIG. 9 illustrates, in an enlarged view, the configuration of the feeding block. As shown in FIG. 9, the feed probe 31 formed by a coaxial line is comprised of a central conductor 31*a* and an external conductor 31*b*. The central conductor 31*a* protrudes from the upper surface of the ground plate 34 by approximately ¼ the wavelength, while the external conductor 31*b* terminates at the upper surface of the ground plate 34. On the periphery of the hole formed in the ground plate 34 is provided a circular conductor member 32. As shown in FIG. 9, the circular conductor member 32 is spaced away from the feed probe 31, in particular the external conductor 31*b*, and extends from the upper surface of the ground plate 34 to the lower surface of the same by a length (height or depth) equal to ¼ the wavelength. The feed probe 31 is inserted into the hollow portion of this circular conductor member 32 so as not to contact with the circular member 32. Because of the presence of the circular conductor member 32, radio waves can be prevented from leaking from a gap between the feed probe 31 and the circular conductor member 32 to the lower surface of the ground plate 34, even when the feed probe 3 and the ground plate 34 are kept from contact with each other. Thereby, electric property equivalent to that when both members contact with each other is obtained.

Alternatively, in order to prevent radio wave leakage from the lower surface of the ground plate 34, instead of providing the circular conductive member 32, at least the conductive inner surface of the hole formed in the ground plate 34 may be extended from the upper surface to the lower surface by a length equal to about λ/4, as shown by the dotted line in FIG. 9.

In Aspect 1-2, because the ground plate 34 is kept from contact with the feed probe 31, the feed probe 31 is not rotated, even when the ground plate 34 is driven for rotation by the motor 35 in order to track the artificial satellite in the azimuth direction, and therefore a rotary joint is not required between the feed probe 31 and the high frequency circuit 39. Further, according to the tracking antenna system in Aspect 1-2, when the artificial satellite is tracked, tracking in the direction of the elevation angle is eliminated, because the height H2 of the main reflector 3 of the antenna is set to a relatively small value and the width of directing beams toward the artificial satellite is expanded in a plane at the elevation angle. As a result, an area or space for driving the antenna in the direction of the elevation angle can be eliminated. Still further, a motor for tracking the elevation angle and a driving circuit for driving the same may be dispensed with, and therefore only component elements which are lightweight and can be formed of metal, such as the sub-reflector 2 and the main reflector 3, need be mounted on the ground plate 34 functioning as a turntable for tracking the azimuth. Further, since the polarizer 500 may be composed, for example, of the grooves 510 formed on the reflection surface of the main reflector 3 as described in Aspect 1, weight is not substantially increased by the polarization conversion function. Accordingly, the motor 35 for driving the ground plate 34 can be downsized. In addition, motors, circuits such as a motor driving circuit, etc. which requires electric power, need not be arranged on the ground plate 34, thereby eliminating need for a slip ring.

According to the tracking antenna system in Aspect 1-2, the construction of the antenna block itself can be simplified, and the whole system is inexpensive and lightweight, leading to a lower-profile tracking antenna system which is very suitable for use in an in-vehicle satellite tracking antenna system.

[Aspect 1-3]

Figure 10:
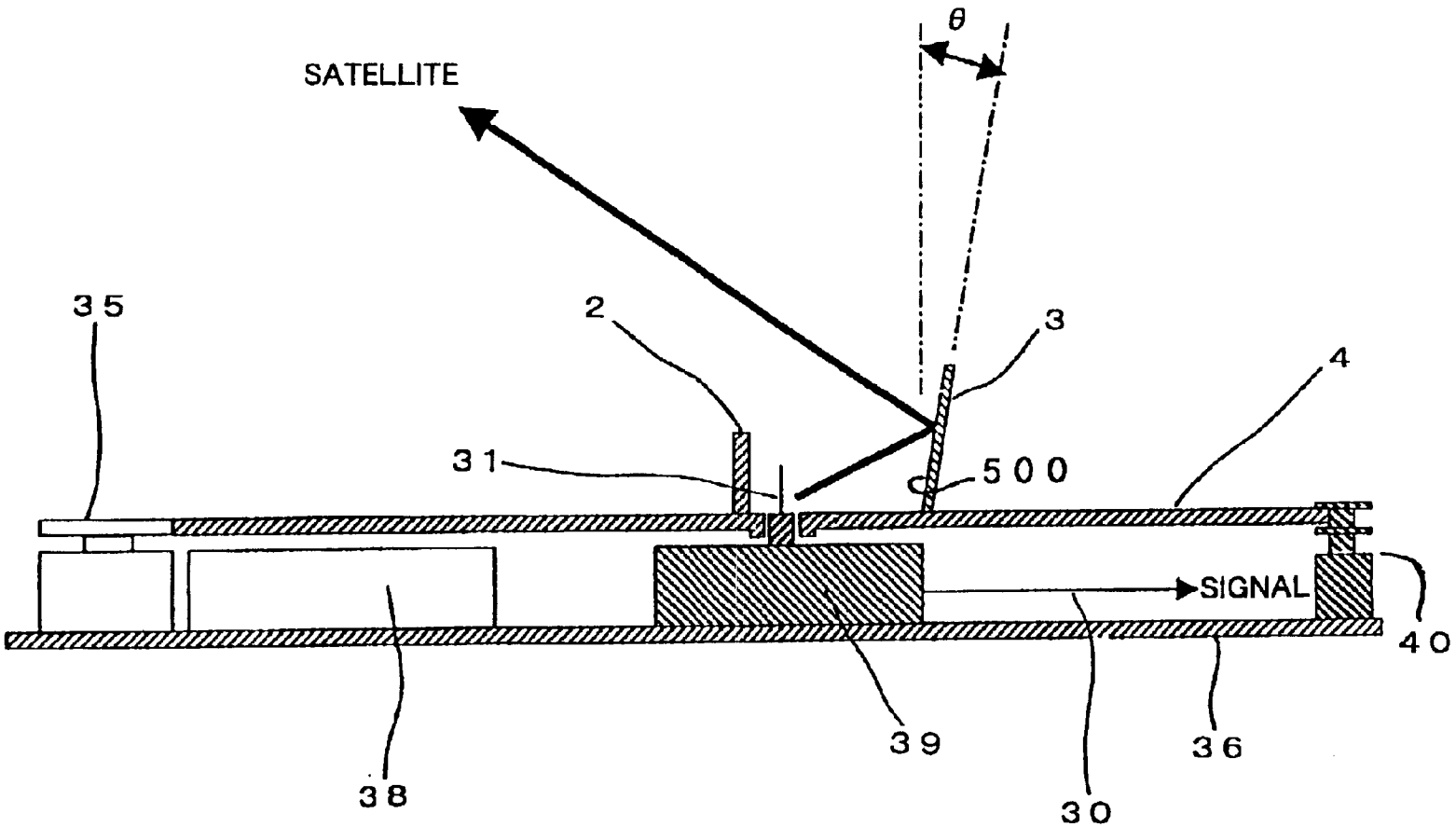
FIG. 10 is a cross sectional view showing the configuration of an antenna system according to Aspect 1-3 of the present invention.

FIG. 10 illustrates the configuration of a tracking circular polarized antenna system according to Aspect 1-3 of the present invention. The tracking antenna system of Aspect 1-3 differs from that of Aspect 1-2 only in the addition of a driving mechanism for tracking in the azimuth. Other parts of the structure are identical to those of Aspect 1-2, and therefore will not be described again. In Aspect 1-3, a plurality of (e.g. three) guides are arranged at the periphery of the ground plate 34, in place of the bearing 37 in FIG. 8, so that the guides 40 engage the edge of the ground plate 34, to thereby support the ground plate 34 on the base stand 36 in a rotatable manner. Driving of the ground plate 34 for rotation in the azimuth direction is carried out by the motor 35, as in Aspect 1-2.

The bearing 37 shown in FIG. 8, in the inner periphery of which the high frequency circuit 39 must be incorporated, should be relatively large. The large-sized bearing 37 of this type is expensive and can not be readily reduced in size. In addition, the bearing 37 limits the area of the base stand 36 on which a circuit substrate etc. are placed. On the other hand, the construction of the antenna system in Aspect 1-3, in which such a bearing is eliminated, can realize a satellite tracking circular polarized antenna system which is less expensive and has a smaller profile.

[Aspect 2]

Figure 11A:
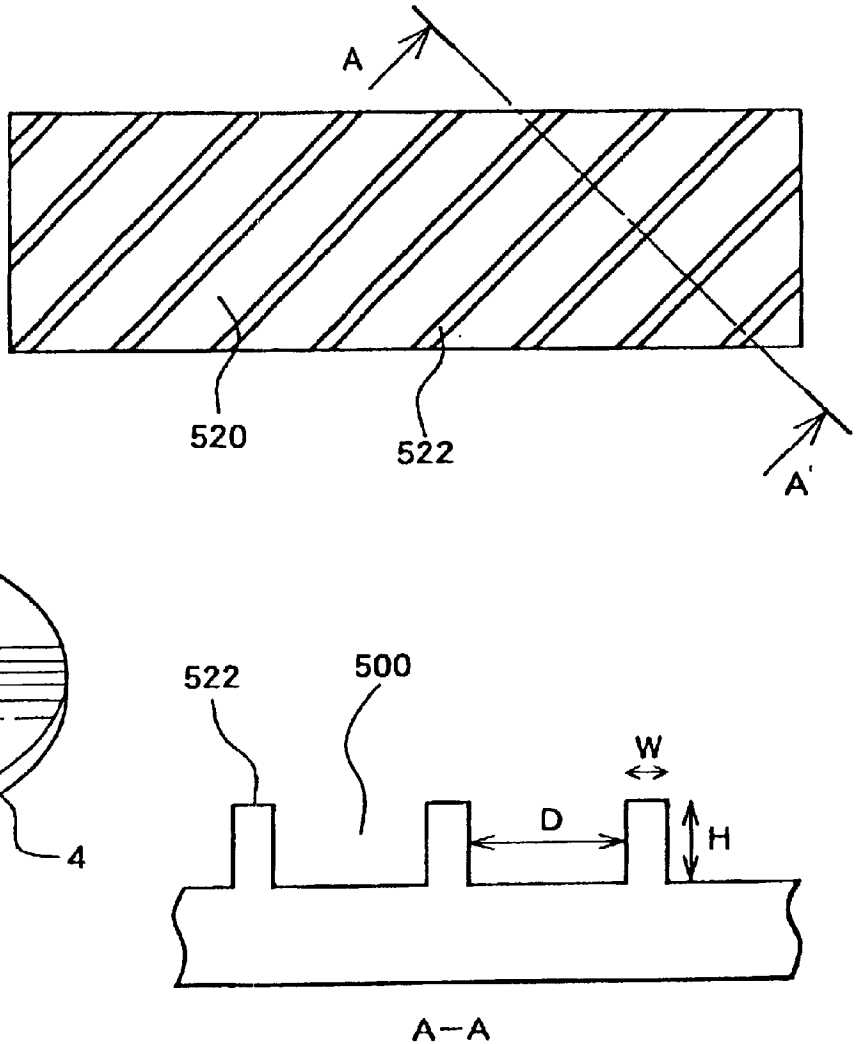
FIG. 11A is a cross sectional view showing the configuration of a polarizer taken along line A—A of FIG. 11.
Figure 11:
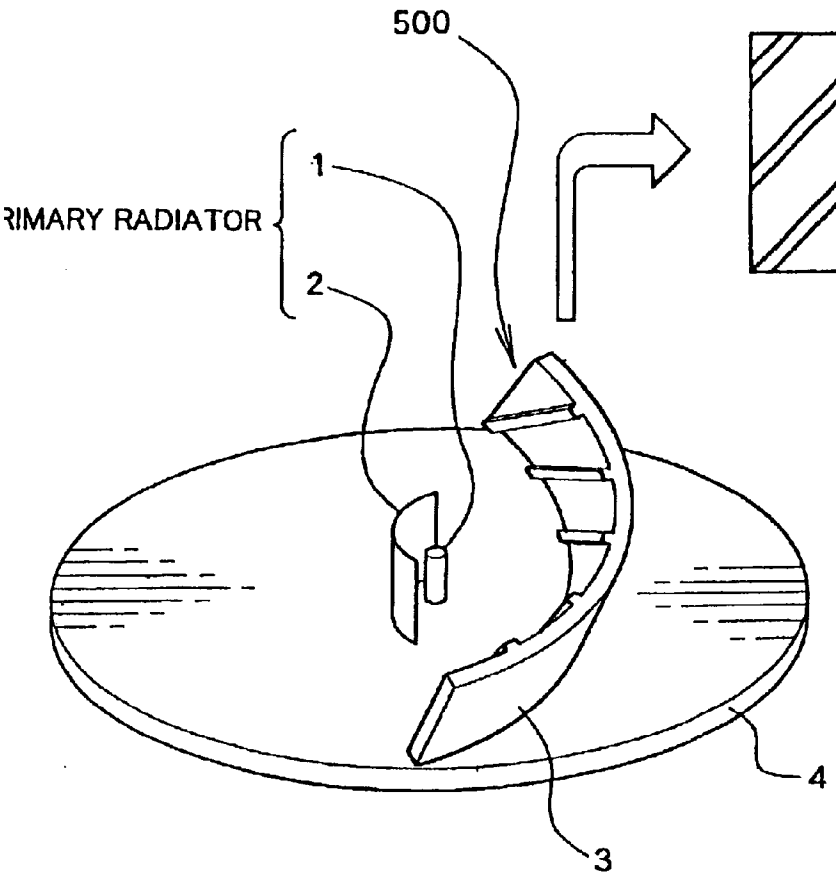
FIG. 11 is a perspective view showing the configuration of an antenna system according to Aspect 2 of the present invention.

A circular polarized antenna system according to Aspect 2 of the present invention will be described with reference to FIGS. 11 and 11A. The antenna system in Aspect 2 differs from that of Aspect 1 only in the converting function of the polarizer 500 disposed on the reflection surface of the main reflector 3. The remaining structure corresponds to that of Aspect 1 and therefore will be not described again.

The polarizer 500 is created by forming a plurality of grooves 520 in the mirror surface of the main reflector 3. These grooves 520 enable conversion between linear polarization and circular polarization by changing relative phases of two components of a radio wave orthogonal to each other. Each groove 520 extends at an angle of approximately 45° with respect to the normal line (vertical direction) of the ground plate 4 as in Aspect 1, but the grooves of Aspect 2 differ from those in Aspect 1 in the dimension and the converting function. According to Aspect 2, when the wavelength to be used is λ0, the groove 520 has a height H of approximately (⅜) λ0 and a width D of 0.671λ0, while a width W of the ridges (convex portions) 522 formed between the grooves 520 is 0.1λ0.

Figure 12:
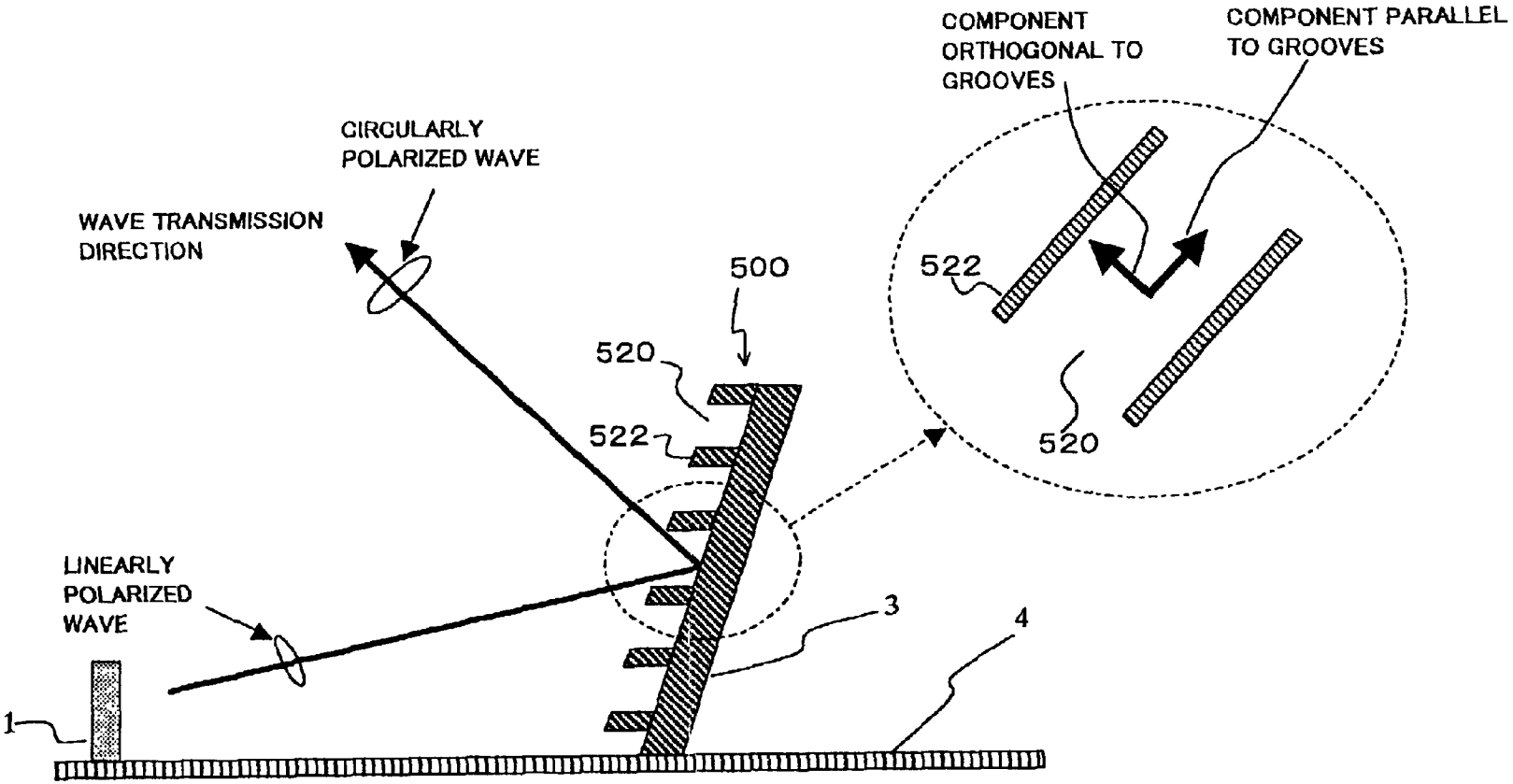
FIG. 12 is a cross sectional view for explaining the operation principle of the antenna system according to Aspect 2 of the present invention.

The operation of this antenna systems will be described with reference to FIG. 12. Wave transmission will be first described. When a wave radiated from the feed probe 1 standing in the vertical direction with respect to the ground plate 4 is reflected by the plane reflector, the wave is composed only of electric field components vertical to the ground plate 4. In other words, the wave is a linearly polarized wave in the normal line direction of the ground plate 4.

When such a linearly polarized wave enters the polarizer 500 of Aspect 2, of the radio wave incident on the main reflector, a component parallel to the grooves 520 expands the wavelength while it is transmitted from the upper surface (upper end) of the ridges 522 formed between the grooves, to the bottom of the groove 520. A component orthogonal to the grooves 520, on the other hand, is, as in a free space, free from influence of the grooves. In this manner, during propagation of a radio wave between the grooves, a phase difference is generated between the two electric field components parallel and orthogonal with regard to the grooves. By adjusting the width D and the height H of the grooves such that a phase difference between these two electric field components is 90°, linear to circular polarization conversion can be obtained when the wave is reflected by the main reflector 3. Although various combinations of the gap D and the height H of the grooves are possible, the relationship between them may be determined as follows:

The wavelength λp of a component parallel to the groove and propagating through the groove is represented by the following expression (i)

$$\lambda p = \lambda o / \sqrt{\alpha} \qquad \text{(i)}$$

$$\alpha = 1 - \left(\frac{\lambda o}{2D}\right)^2$$

The wavelength of a component orthogonal to the groove and propagating through the groove is λ0, as in a free space. Accordingly, assume that a phase difference generated for these two components is β, the following expression (ii) can be obtained.

$$\beta = 360 \times \left(\frac{2H}{\lambda o} - \frac{2H}{\lambda p}\right) = 360 \times \frac{2H}{\lambda o} \times \left(1 - \sqrt{\alpha}\right) \qquad \text{(ii)}$$

When the width D of 0.671λ0 and the height H of (⅜)λ0 is selected for the grooves, the phase difference β of 90° can be obtained to thereby generate a circularly polarized wave.

Although a plurality of combinations of D and H are possible, as long as they satisfy the above-described expressions, the width D of the groove must be longer than ½ the wavelength λ0 to be used, such that the electric field component parallel to the grooves enters inside the groove. Also, it is more preferable that the width W of the ridges 522 formed between the grooves be as small as possible so as to reduce loss of signal strength due to reflection of radio waves from the upper surface of the ridges.

A circularly polarized wave can also be generated when β=270°, 450°, . . . Considering this fact, the following expression (1) can be obtained from the foregoing expressions (i) and (ii).

$$H = (2n-1) \times \frac{\lambda o}{8\left(1-\sqrt{1-\left(\frac{\lambda o}{2D}\right)^2}\right)} \quad (1)$$

$$n = 1, 2, \ldots$$

By determining the values of the width D and the height H of the groove so as to satisfy the expression (1), it is possible, when a radio wave is reflected by the main reflector 4, to convert a linearly polarized wave to a circularly polarized wave which is then transmitted toward a satellite, and to convert a circularly polarized wave transmitted from a satellite into a linearly polarized wave which is then received by the primary radiator.

In Aspect 2, the main reflector 3 may be parabolic as shown in FIG. 5, and the feed probe 1 may be a sleeve dipole antenna element 11 shown in FIG. 6 and described in Aspect 1-1.

Further, when the ground plate 4 is constructed such that it can rotate along with the sub-reflector 2, the polarizer 500 and the main reflector 3 around the feed probe 1 in a manner of being non-contact therewith, a tracking antenna which is small in size and has a low profile can be achieved.

[Aspect 3]

Figure 13:
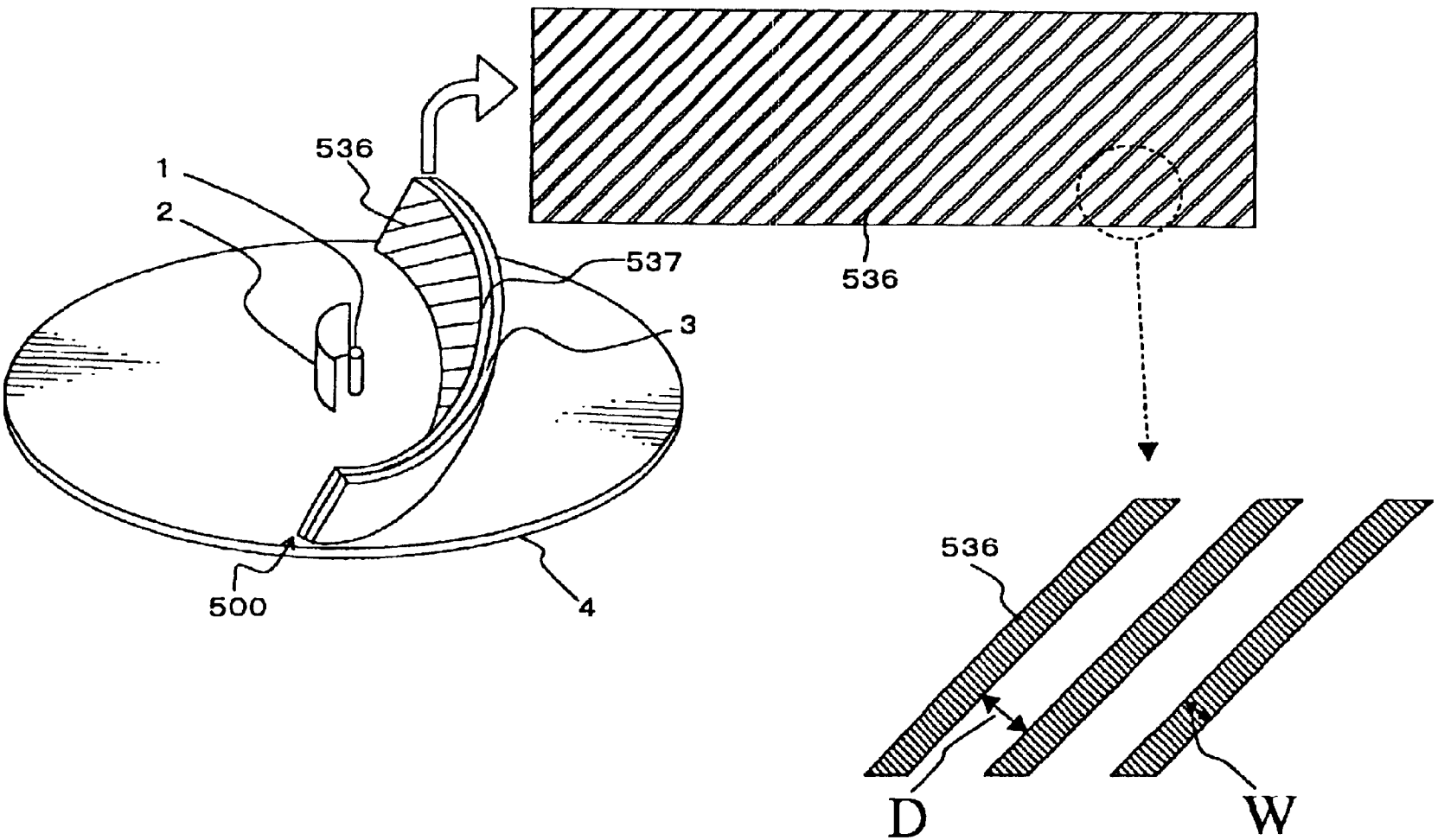
FIG. 13 shows the configuration of an antenna system according to Aspect 3 of the present invention.

The antenna system in accordance with Aspect 3 of the present invention will be described with reference to FIG. 13. The structure of the polarizer employed in the antenna system in Aspect 3 differs from that of the antenna system in Aspect 1 in which the polarizer is composed of grooves (and ridges) formed on the reflection surface of the main reflector. Otherwise, the system, including the feed probe 1, the sub-reflector 2, the main reflector 3, and disc-type ground plate 4, is identical to the antenna system of Aspect 1.

The polarizer 500 in the present aspect is composed of a linear conductor element 530 having a plurality of linear conductors 536 arranged at fixed intervals, and the surface of the linear conductor element 530 and the mirror surface of the main reflector 3 are used to change relative phases of two components of a radio wave orthogonal to each other for conversion between linear polarization and circular polarization. The linear conductor element 530 is disposed at a predetermined distance H in front of the mirror surface of the main reflector 3, with the conductors 536 extending so as to incline at approximately 45° with regard to the normal line direction of the ground plate 4. The conductors 536 are arranged such that the gap D between the conductors 536 is smaller than ½ the wavelength λ0 and the above-described distance H is an odd multiple of ⅛λ0. More specifically, in Aspect 3, the width W of the conductor is 0.02λ0 while the gap between the conductors is 0.1λ0. The conductor element 530 is attached to a supporting foam member 537 whose thickness is determined such that the distance H between the surface of the conductors 536 and the mirror surface of the main reflector 3 is ⅛λ0, and this foam member 537 is then attached to the mirror surface of the main reflector 3. The conductors 536 of the conductor element 530 can be produced by, for example, etching a dielectric film substrate. The supporting foam member 537 serves to support the linear conductor element 530 formed on such a dielectric film substrate, and may be preferably composed of a material with low loss. For example, a sheet composed of a foaming material (such as foaming styrol, polyethylene foam, or urethane foam) may be employed. The supporting foam member 537 may be eliminated when the conductor element 530 having rigidity is employed.

Figure 14:
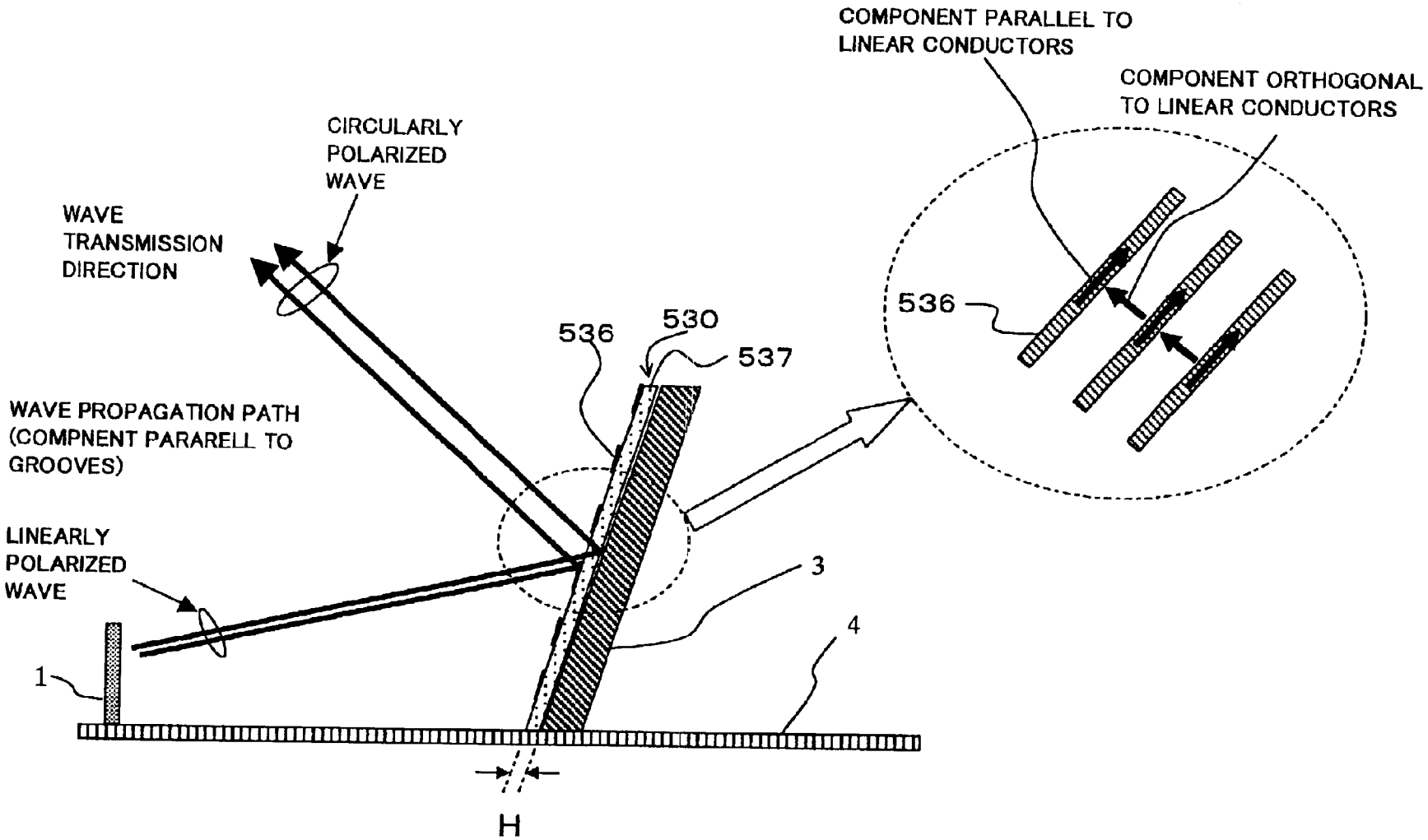
FIG. 14 is a cross sectional view for explaining the operation principle of the antenna system according to Aspect 3 of the present invention.

The operation of the antenna system in Aspect 3 will next be described with reference to FIG. 14.

For wave transmission, a radio wave radiated from the feed probe 1 is reflected by the main reflector 3 and is then transmitted toward the radio wave transmitting direction. As in the above-mentioned aspects, the radio wave radiated from the feed probe 1 standing in the vertical direction of the ground plate is composed only of an electric field component in the vertical direction of the ground plate.

In Aspect 3, the linear conductors 536 are disposed in front of the mirror surface of the main reflector 3 at a predetermined distance away therefrom and extend at approximately 45° with regard to the normal line of the ground plate 4. From a radio wave entering the main reflector 3, an electric field component parallel to the direction of the linear conductors 536 is reflected on the surface of the linear conductors, whereas an electric field component orthogonal to the linear conductors 536 is reflected by the mirror surface of the main reflector 3. Therefore, a difference in paths 2H is generated between the two electric field components orthogonal to each other according to the distance H between the surface of the linear conductors 536 and the mirror surface of the main reflector 3, thereby relatively shifting the phases to be propagated. When the path difference 2H is set to ¼ the wavelength λ0 so that the phase difference is 90°, a linearly polarized wave radiated by the primary radiator toward the main reflector 3 can be converted into a circularly polarized wave. It is preferable that, for conversion between linear polarization and circular polarization, the distance H is an odd multiple of approximately ⅛ the wavelength λ0 to be used. However, this value is preferably adjusted according to the values for the width W of the linear conductor, the gap D between the conductors, and the electrical characteristics of a material of the supporting foam member 537 for supporting the element 530. Also, the gap D between the linear conductors 536 must be ½ the wavelength λ0 to be used so that the electric field component of the radio wave entering the main reflector 3 which is parallel to the linear conductors 536 will not reach the mirror surface of the main reflector 3.

For wave reception, on the other hand, an incoming circularly polarized wave can be converted into a linearly polarized wave when reflected by the main reflector. Accordingly, effective reception of a circularly polarized wave can be achieved even with the feed probe capable of receiving only electric field components in the vertical direction.

As described above, according to Aspect 3, a simple method, in which the element 530 composed of a plurality of linear conductors is disposed in front of the main reflector at a predetermined distance therebetween, enables transmission and reception of a circularly polarized wave with a low-profile antenna system. In particular, the antenna system in Aspect 3 is notably advantageous over the antenna systems in Aspects 1 and 2 in that the grooves need not be formed in the main reflector and the linear polarized antenna can be used for circular polarization.

In Aspect 3, the main reflector 3 may be parabolic as shown in FIG. 5, and the feed probe 1 may be a sleeve dipole antenna element 11 described in Aspect 1-1.

Further, when the ground plate 4 is constructed such that it can rotate together with the sub-reflector 2, the polarizer 500 and the main reflector 3 around the feed probe 1 in a manner of being non-contact therewith, the tracking antenna can be achieved.

[Aspect 4-1]

Figure 15:
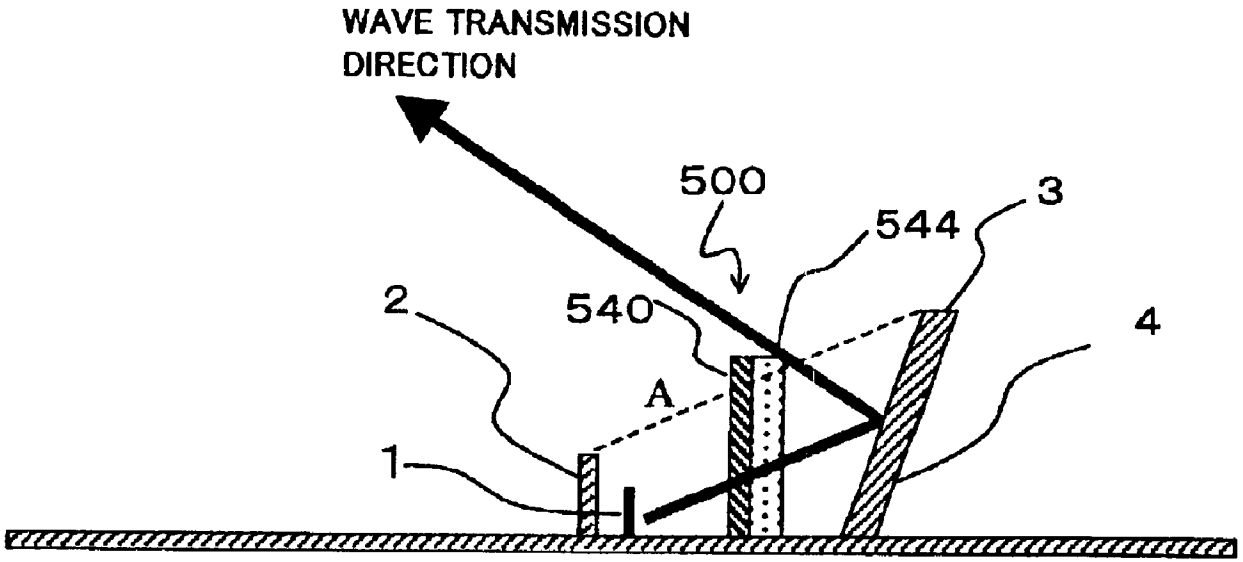
FIG. 15 is a cross sectional view showing the configuration of an antenna system according to Aspect 4-1 of the present invention.

The antenna system according to Aspect 4-1 will be described with reference to FIGS. 15 and 16. In the present aspect, the polarizer is disposed in a radiation space between the primary radiator and the main reflector on the ground plate. Otherwise, the structure is identical to the antenna systems in the above-mentioned aspects.

The antenna system in Aspect 4-1 comprises, in addition to the feed probe 1, the sub-reflector 2, the main reflector 3, and the disc-shaped ground plate 4, the polarizer 500 disposed between the feed probe 1 which is part of the primary radiator and the main reflector 3. The polarizer 500 is composed of a plurality of meander-line conductor element 540 and a foaming member 544 supporting the element 540. The conductor element 540 supported by the foaming member 544 stands on the ground plate 4 at a location between the main reflector 3 and the feed probe 1, as shown in FIG. 15.

Figure 16:
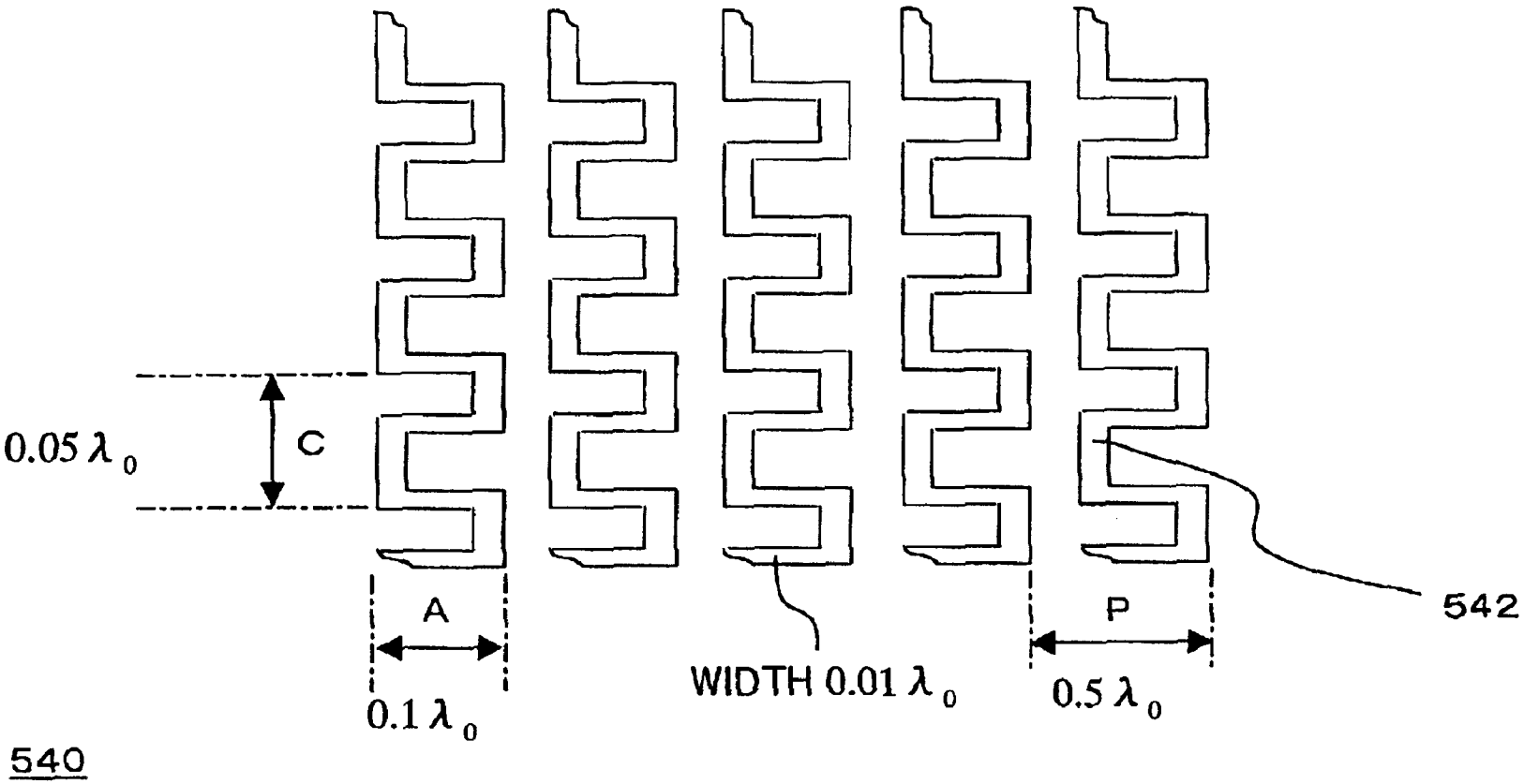
FIG. 16 illustrates the configuration of a meander-line conductor element 540 of FIG. 15.

The conductor element 540 is composed of a plurality of meander-line conductors 542 arranged as shown in FIG. 16. For example, the gap P between the conductors 542 is 0.5λ0, the period C of each conductor 542 is 0.05λ0, the amplitude A is 0.1λ0, and the width of each conductor 542 is 0.01λ0. A linearly polarized wave entering the meander-line conductor element 540 is converted into a circularly polarized wave for radiation. To the contrary, when a circularly polarized wave enters such conductor element 540, a linearly polarized wave is generated. Accordingly, by providing such a conductor element 540 between the feed probe 1 and the main reflector 3, it is possible to transmit a circularly polarized wave, or to receive a circularly polarized wave transmitted from the satellite or the like. The meander-line conductor element 540 provided with the above-mentioned polarization converting function can be easily produced by etching a dielectric film substrate. When such a substrate is employed, it is preferable to support the conductor element 540 with a foaming member 544 composed of a sheet with low loss made of a foaming material, because the dielectric film substrate itself does not have great rigidity. Of course, the foaming member 544 shown in FIG. 15 can be eliminated when the linear conductor element 540 is formed on a substrate with high rigidity.

In Aspect 3, it is necessary to arrange the meander-line conductor element 540 such that most electric power of the radio wave to be transmitted and received will pass through the conductor element 540 so as to reduce power loss. Accordingly, as shown in FIG. 15, the conductor element 540 must extend from the reflection surface, which is an upper surface, of the ground plate 4 to the position shown a dot line connecting upper ends of the sub-reflector 2 and the main reflector 3. However, when, for example, the conductor element 540 is too high for wave transmission, a radio wave reflected on the main reflector 3 for radiation toward the satellite is blocked by the conductor element 540. Accordingly, the height of the conductor element 540 should preferably be reduced as much as possible. Also, the conductor element 540 should preferably be disposed close to the feed probe 1 as long as the conductor element 540 does not affect the characteristics of the feed probe 1 because, with the element 540 being closer to the feed probe 1, the height of the element can be lower, thereby lowering the possibility of blocking the wave reflected by the main reflector 3.

According to Aspect 4-1, a simple structure in which the polarizer 500 is disposed on the ground plate so that it is spaced from the main reflector by a predetermined distance enables deployment of an antenna system capable of transmitting and receiving circularly polarized waves.

As in the above-described aspects 2 and 3, the main reflector 3 of the present aspect may be parabolic as shown in FIG. 5, and the feed probe 1 may be a sleeve dipole antenna element 11 described in Aspect 1-1. Further, when the ground plate 4 is constructed such that it, together with the sub-reflector 2, the polarizer 500, and the main reflector 3, can rotate around the feed probe 1 in a non-contact manner, a tracking antenna can be achieved.

[Aspect 4-2]

Figure 17:
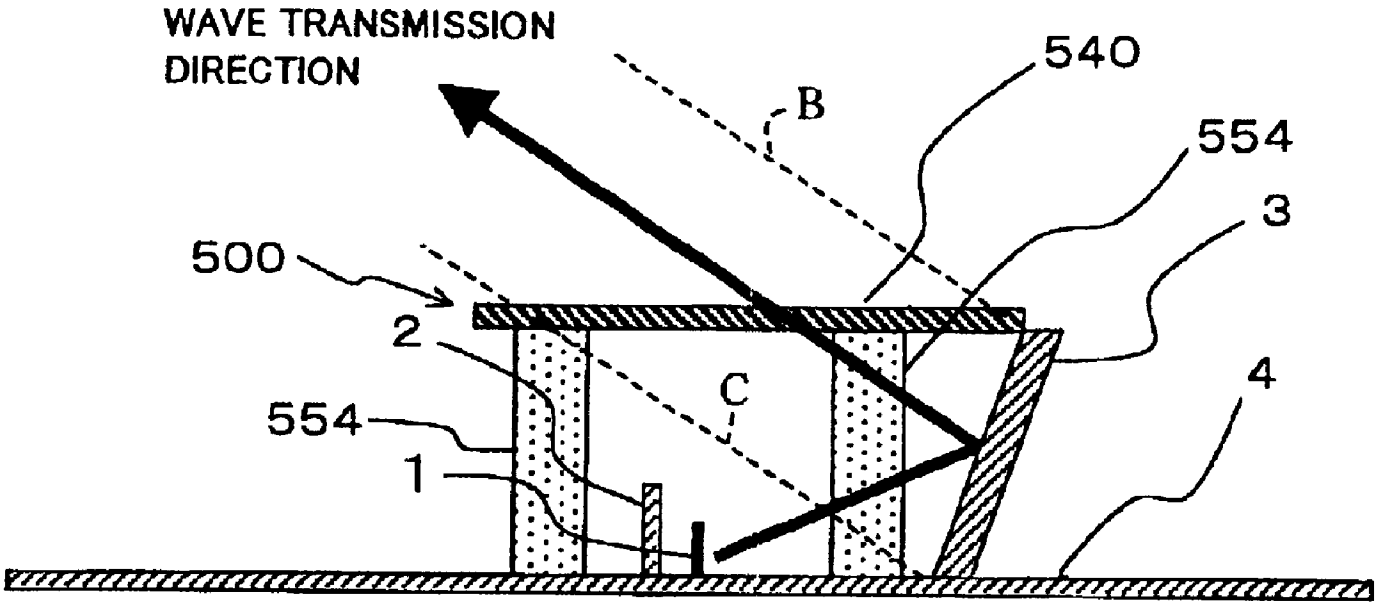
FIG. 17 is a cross sectional view showing the configuration of an antenna system according to Aspect 4-2 of the present invention.
Figure 18A:
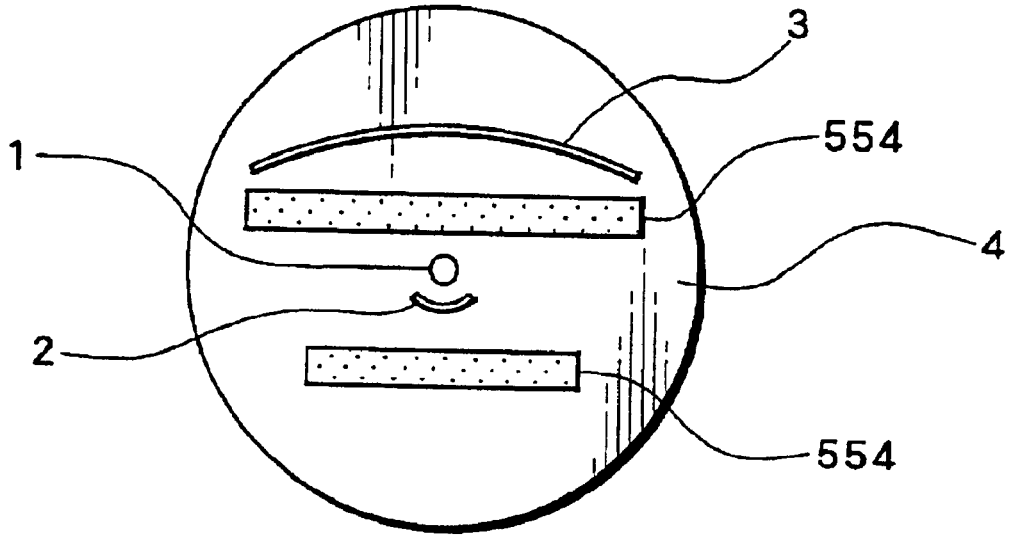
FIGS. 18A and 18B illustrate locations of the supporting foam members in the antenna system of FIG. 17.

The antenna system in Aspect 4-2 shown in FIG. 17 differs from the antenna system in Aspect 4-1 comprising the polarizer 500 disposed between the feed probe 1 and the main reflector 3, in that the polarizer 500 is disposed between the main reflector 3 and the satellite to or from which radio waves are radiated, namely in a direction that radio waves are received (or in a direction that radio waves are transmitted) above the main reflector 3. Similar to Aspect 4-1, the polarizer 500 is composed of a conductor element 540 comprising a plurality of meander-line conductors 542 as shown in FIG. 16. Further, the supporting foam members 554 are disposed outside the sub-reflector 2, and between the feed probe 1 and the main reflector 3, respectively, so as to support the conductor element 540 in parallel to the direction of a plane of the ground plate 4 above the main reflector 3 (see FIG. 18A).

In Aspect 4-2, the conductor element 540 must be supported by the supporting foam members 554 so as to cover an area defined by dot lines B and C extending in parallel to each other in the wave transmission direction from upper and lower ends of the main reflector 3.

Figure 18B:
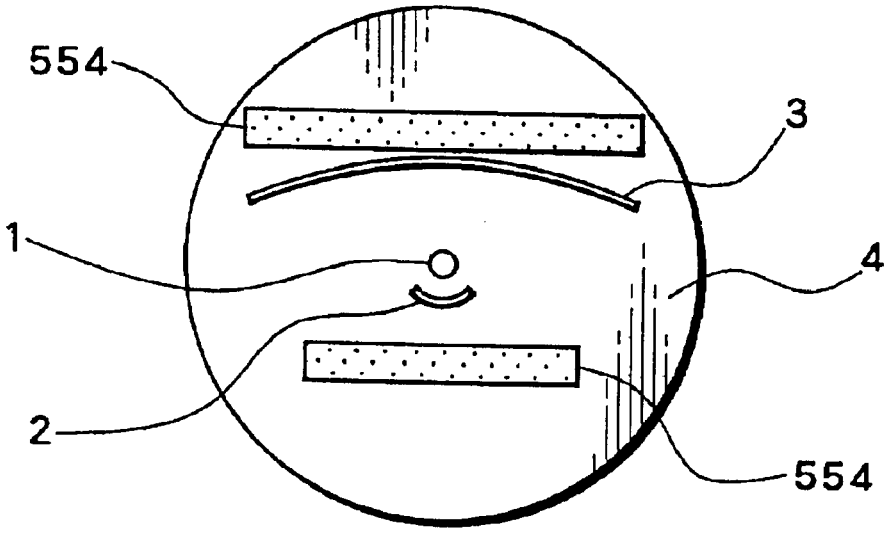

The supporting foam members 554 may be composed of a sheet capable of transmitting radio waves with little or no loss. Further, the locations of the supporting foam members 554 are not limited to the example shown in FIG. 18A, as long as they can support the conductor element 540. For example, the supporting foam members 554 may be disposed outside the sub-reflector 2 and the main reflector 3, as shown in FIG. 18B. When the supporting foam members 554 are disposed on the ground plate 4 such that they do not block the wave radiation path, as described above, power loss due to the supporting foam members 554 can be desirably prevented. Further, when the main reflector 3 is sufficiently rigid, the conductor element 540 may be supported by the main reflector 3 and the supporting foam member 554 disposed outside the sub-reflector 2.

[Aspect 5]

Figure 19:
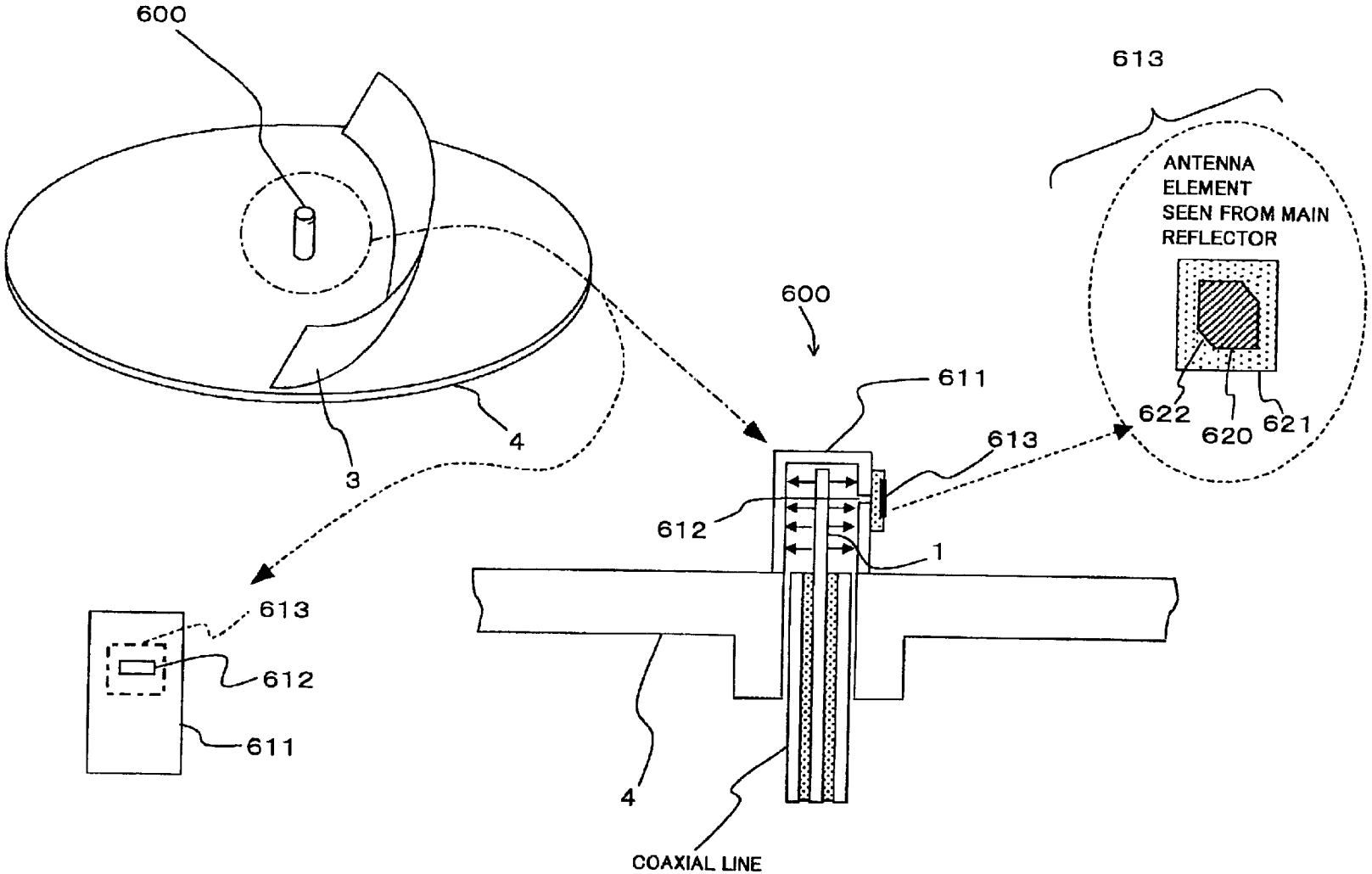
FIG. 19 illustrates the configuration of an antenna system according to Aspect 5 of the present invention.

FIG. 19 shows the configuration of the antenna system according to Aspect 5. The antenna system in Aspect 5 differs from the above-described aspects in the that the primary radiator 600 transmits and receives a circularly polarized wave, not a linearly polarized wave. The antenna system according to Aspect 5 comprises a primary radiator 600 and a main reflector 3 disposed on the disc-shaped ground plate 4.

The primary radiator 600 in Aspect 5 comprises a feed probe 1, a feed probe external conductor 611, a feed slot 612, and a circular polarized radiation antenna element 613. As in the aspect shown in FIG. 9, the feed probe 1 formed by a coaxial line is composed of a central conductor and an external conductor. The external conductor terminates at the reflection surface of the ground plate 4 and the central conductor protrudes from the reflection surface by a predetermined length. The feed probe external conductor 611 of the same potential as the ground plate 4 is further disposed on the ground plate 4 such that it protrudes from the ground plate 4 while surrounding the feed probe 1. The feed slot 612 is formed on this external conductor 611 at a location opposing the main reflector 3, and the circular polarized antenna element 613 is further provided outside the feed slot 612. Electric power is fed to the antenna element 613 through an electromagnetic coupling between the antenna element 613 and the feed probe 1, so that, for wave transmission, a circularly polarized wave is radiated toward the opposing main reflector 3 while, for wave reception, an incoming circularly polarized wave reflected from the main reflector 3 is received. This received wave is transferred to the feed probe 1.

The circular polarized antenna element 613 may be composed of, for example, of a micro-strip antenna element formed by etching a dielectric substrate which may comprise a radiation conductor 620 having a partial cutout 622 on the dielectric substrate 621. According to the present aspect, the cutout 622 allows the radiation conductor 620 to excite circular polarization, thereby enabling an operation using circular polarization. The configuration of the radiation conductor 620 is not limited to the example shown in FIG. 19, as long as it enables excitation of a circularly polarized wave.

The antenna system which employs the primary radiator 600 according to Aspect 5 can also be easily applied to a rotatable tracking antenna system as in the above-mentioned aspects 1-2 and 1-3. The configuration of the feeding block employed in a rotatable antenna system will be described, in which the rotation mechanism other than that for the feeding block is identical with Aspects 1-2 and 1-3.

As depicted in the figure at the lower right of FIG. 19, the feed probe external conductor 611 is secured to the ground plate 4 such that the feed slot 612 and the antenna element 613 face the main reflector 3. The feed probe 1 is inserted through a hole formed at the rotation center of the ground plate 4 from the lower surface thereof so as not to contact with the ground plate 4.

This configuration enables the ground plate 4 to freely rotate around the feed probe 1 serving as the rotation center, with the antenna element 613 being continuously fed with a electric power by electromagnetic coupling with the feed probe 1 during rotation. Further, since the relative position between the antenna element 613 and the main reflector 3 both mounted on the ground plate 4 does not change, the antenna system of the present aspect can eliminate the need for the sub-reflector disposed as part of the primary radiator 600 behind the feed probe 1 in the above-described aspects.

Thus, according to Aspect 5, a low-profile antenna system with a simple structure and which is rotatable and capable of transmitting and receiving a circularly polarized wave can be constructed.

[Aspect 6]

Figure 20:
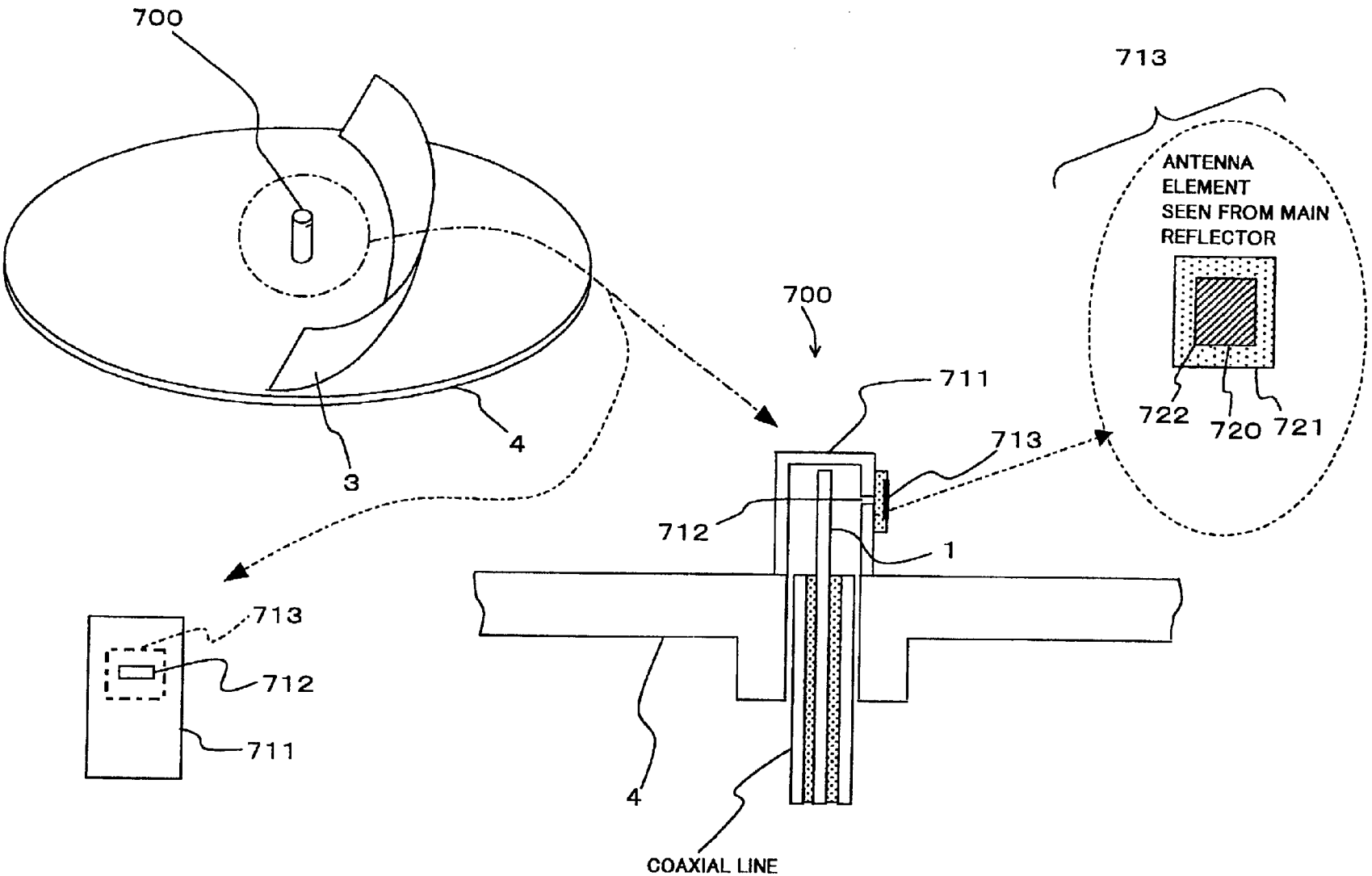
FIG. 20 illustrates the configuration of an antenna system according to Aspect 6 of the present invention.

In Aspect 6, a primary radiator having a configuration similar to that of Aspect 5 is used to constitute a linear polarized antenna system, the configuration of which is shown in FIG. 20. The antenna system in Aspect 6 differs from the antenna system in Aspect 5, in which the primary radiator 600 radiates a circularly polarized wave, only in that the radiator 720 which forms the antenna element 713 of the primary radiator 700 includes no cutout portions. Only this feature will be described.

In Aspect 6, the primary radiator 700 comprises a feed probe 1 and a feed probe external conductor 711. The feed probe 1 is composed of a coaxial line, of which the central conductor protrudes from the upper surface (reflection surface) of the ground plate 4 while the outer conductor terminates at the reflection surface. The feed probe external conductor 711 is disposed on the ground plate 4 so as to surround the feed probe 1 and is electrically connected to the ground plate 4. The feed slot 712 is further formed in the feed probe external conductor 711 at a position facing the main reflector 3. The linear polarized antenna element 713 is disposed in the vicinity of the slot 712 of the feed probe external conductor 711 so that electromagnetic coupling between the antenna element 713 and the feed probe 1 can be obtained via the slot 712. The linear polarized antenna element 713 comprises a rectangular radiation conductor 720 formed on a dielectric substrate 712. Electric power is fed to the radiation conductor 720 by electromagnetic coupling with the feed probe so that, for wave transmission, the radiation conductor 720 radiates a linearly polarized wave to the main reflector 3 while, for a wave reception, an incoming linearly polarized wave is reflected by the main reflector and is then supplied to a receiving circuit (not shown) via the radiation conductor 720 of the antenna element 713 and the feed probe 1.

According to the configuration of Aspect 6, the total height of the complete antenna system depends on the height of the main reflector 3, and a compact antenna system with a very low profile and small can be obtained. Further, a satellite tracking antenna system or the like can be implemented when the ground plate 4 is constructed such that it can rotate around the feed plate 1, which is kept non-contact with the ground plate 4 as in the above-described aspects 1-2 or 1-3.

[Aspect 7]

Figure 21:
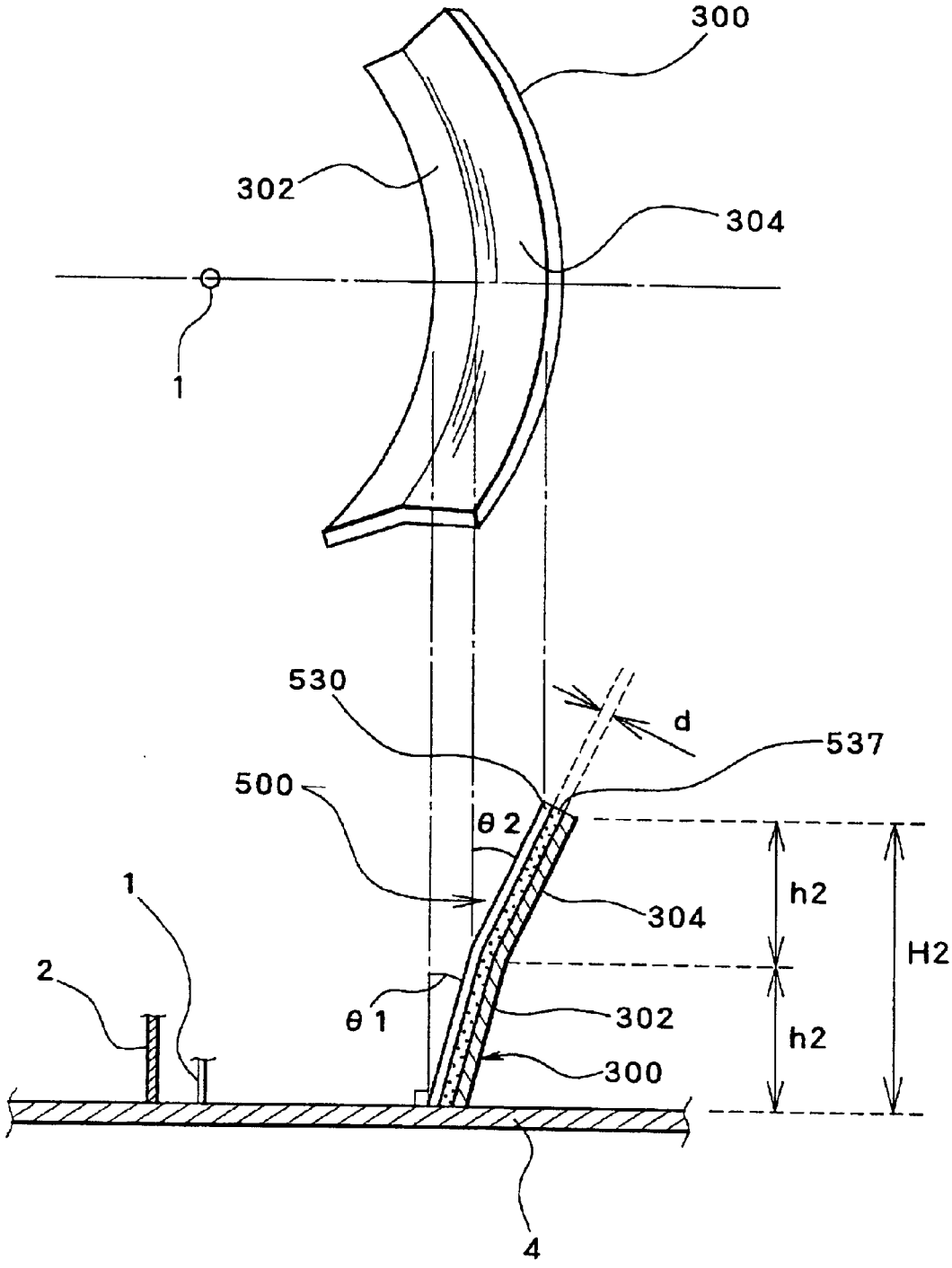
FIG. 21 illustrates the configuration of an antenna system according to Aspect 7 of the present invention.
Figure 22:
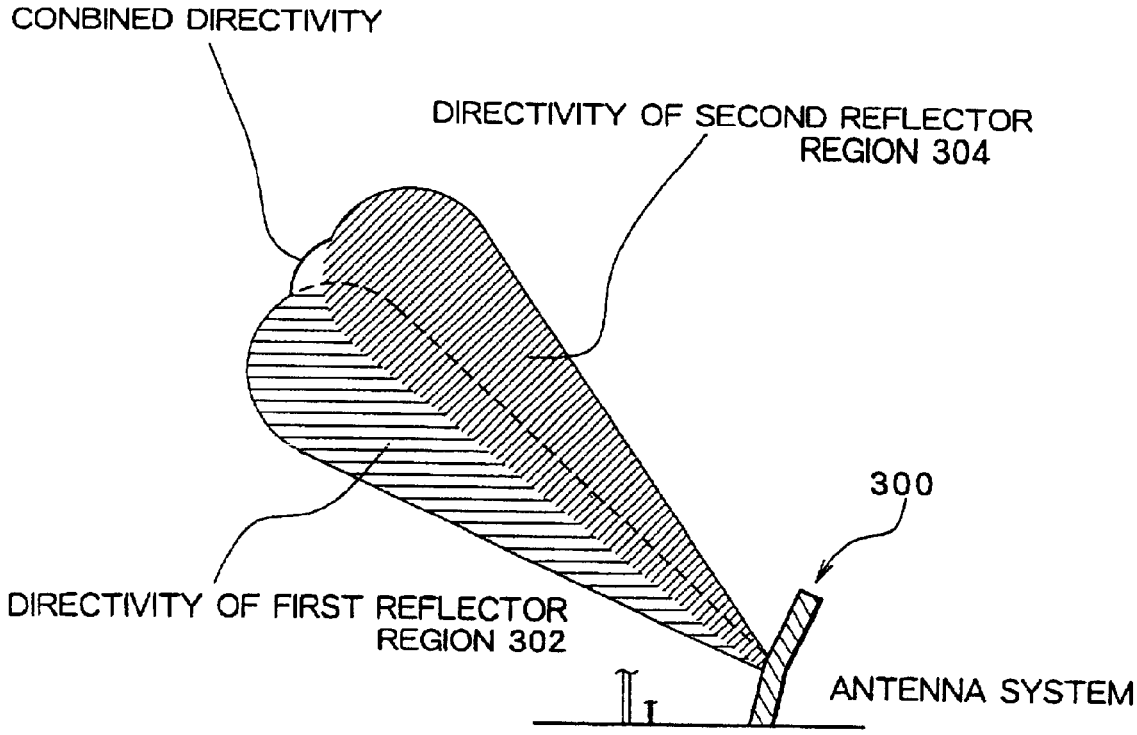
FIG. 22 illustrates the directivity of the antenna system according to Aspect 7 of the present invention.

The antenna system according to Aspect 7 differs from those of the referenced aspects in the main reflector 300. FIG. 21 illustrates the configuration of the antenna system of this aspect, in particular schematic plan and cross-sectional configuration of the main reflector 300. FIG. 22 shows the directivity of the antenna system using the main reflector thus constructed. For other parts of the antenna system, such as the primary radiator, the ground plate 4, and the azimuth tracking mechanism for use in a satellite tracking antenna, any appropriate configuration described in any of the above-described aspects may be employed.

The main reflector 300 in Aspect 7 can be combined with any of the polarizers described in the foregoing aspects to constitute a circular polarized antenna system. Further, the main reflector 300 is also applicable to a linear polarized antenna system which does not comprise a polarizer, and also to a linear polarized satellite tracking antenna system.

The main reflector 300 as employed in Aspect 7 will next be described. The main reflector 300 stands on the ground plate 4 at an inclination angle θ according to the elevation angle in a direction that receives radio waves or a direction that radiates radio waves, with regard to the normal line of the ground plate 4. The main reflector 300 includes a plurality of regions having different inclinations with respect to the normal line of the ground plate 4. For example, the main reflector 300 shown in FIG. 21 comprises a first reflector portion 302 at the bottom and a second reflector portion 304 at the top, having inclination angles of θ1 and θ2, respectively. Unless the angles θ1 and θ2 are identical, the directivity of the first reflector portion 302 having θ1 in a plane at the elevation angle differs from the directivity of the second reflector portion 304 having θ2 in a plane at the elevation angle. Accordingly, when a single main reflector 300 is composed of two regions including two reflection regions 302 and 304 with different inclination angles, two different directivities interfere with each other, so that the main reflector 300 can, as a whole, provide directivity obtained by combining the directivities of the two reflector regions 302 and 304 as shown in FIG. 22. It is thus possible to combine a plurality of reflector regions (302, 304) to thereby combine the directivities, so that the combined directivity (directivity in a plane at the elevation angle) obtained from the main reflector 300 as a whole can be larger than that in the foregoing aspects in which the main reflector 3 has a single mirror surface.

As shown in FIG. 21, the inclination angle of the upper reflection region is larger than that of the lower reflection region in the main reflector 300 (θ1<θ2), but this may also be set so that θ1 is greater than θ2.

Figure 1B:
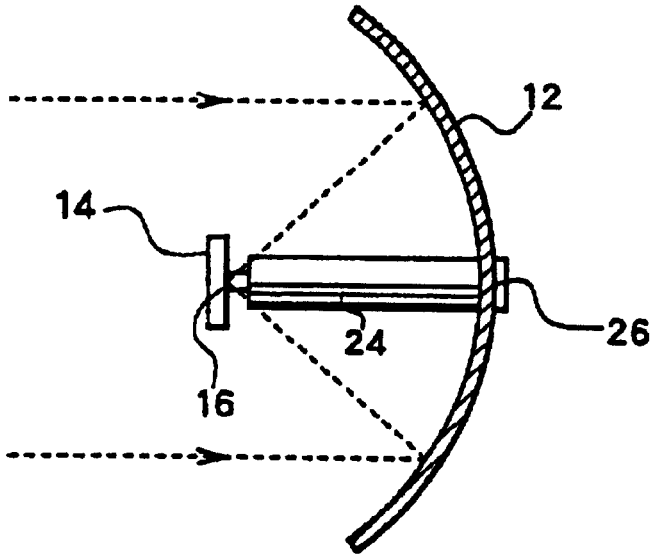
FIG. 1B PRIOR ART
FIG. 1B is a plan view of the antenna system of FIG. 1A.
Figure 1C:
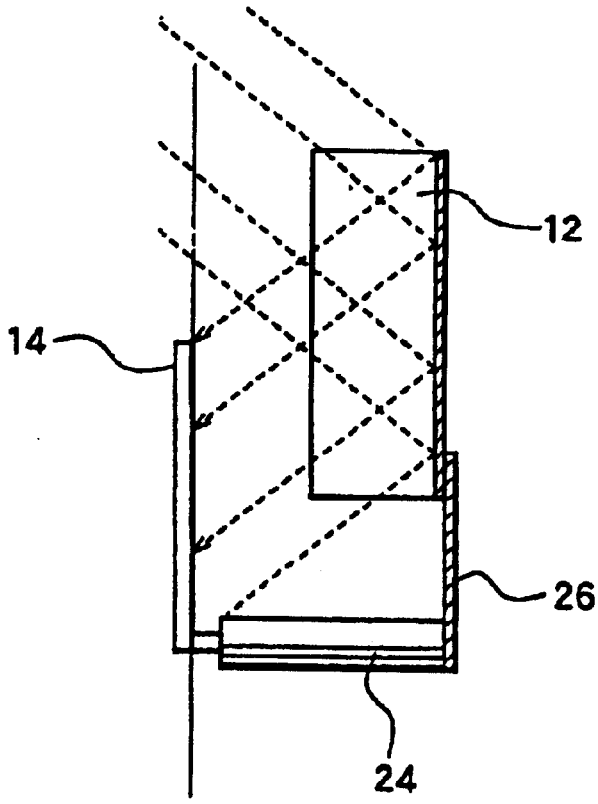
FIG. 1C PRIOR ART
FIG. 1C is a longitudinal sectional view of the antenna system of FIG. 1A.

Each of the first and second reflection regions 302, 304 is a parabolic cylinder as in the main reflector 3 in FIG. 1, and has a focal point or a focal line on which the feed probe 1 is located. The first and second reflector regions 302, 304, each being formed as the above-mentioned parabolic cylinder, can be continuously connected without a step being formed between them.

Referring to FIG. 21, at the surface of the main reflector 300 facing the primary radiator is disposed a polarizer 500, which may have any structure described in any of the foregoing aspects. In the present aspect, the polarizer 500 has a configuration similar to that shown in FIGS. 13 and 14 and described in Aspect 3. Specifically, a supporting foam member 537 serving also as a spacer having a thickness d is disposed on the mirror surface of the main reflector, and a linear conductor element 530 is further attached on the surface of the supporting foam member 537. The thickness d of the spacer shown in FIG. 21 corresponds to the distance H (the depth H of the groove) already described.

As described in the foregoing aspects, the height H2 of the main reflector 300 affects the width of the directional beam in a plane at the elevation angle. Further, by changing the heights h1 and h2 of the first and second reflector regions 302 and 304, respectively, forming the main reflector 300, the directional beam width of each reflector region 302, 304 shown in FIG. 22 can be changed. It is therefore preferable to set the heights h1 and h2 in accordance with the desired directional beam width and gain for the antenna system. The optimum combined directional beam can be obtained more easily by adjusting the heights h1 and h2, than by only changing the inclination angles θ1 and θ2.

While the preferred embodiment of the present invention has been described in the above aspects using specific terms, such description is for illustrative purposes only, and it is to be understood that changes and variations may be made without departing from the spirit or scope of the appended claims.

What is claimed is:

1. An antenna system comprising:

a ground plate;

a primary radiator disposed on an upper surface of said ground plate;

a main reflector having a predetermined focal point or a predetermined focal line and standing on the upper surface of said ground plate such that said focal point or said focal line substantially corresponds to the location of said primary radiator; and a polarizer for converting a radiated radio wave from a linearly polarized wave to a circularly polarized wave, or from a circularly polarized wave to a linearly polarized wave.

2. An antenna system according to claim 1, wherein said polarizer is disposed on a mirror surface of said main reflector or between said main reflector and said primary radiator.

3. An antenna system according to claim 1, wherein said polarizer is disposed between said main reflector and an object to which the antenna system radiates radio waves or which radiates radio waves to the antenna system.

4. An antenna system according to claim 1, wherein said primary radiator includes:

a feed probe disposed so as to protrude from the upper surface of said ground plate; and a sub-reflector facing said main reflector via said feed probe and standing in the vicinity of said feed probe on the upper surface of said ground plate.

5. An antenna system according to claim 4, wherein said feed probe is a sleeve dipole antenna element formed by a coaxial line comprising a central conductor and an external conductor, said external conductor having a sleeve folded by a length equal to approximately ¼ a wavelengths at an end of said coaxial line, said central conductor having a linear conductor extending from the end by a length equal to approximately ¼ said wavelength away from the end.

6. An antenna system according to claim 4, wherein said ground plate is disposed on a bass stand and is rotatable with respect to said base stand around said feed probe so as not to contact with said feed probe.

7. An antenna system according to claim 1, wherein said main reflector stands on said upper surface of said ground plate at an angle according to an elevation angle in a direction that receives radio waves or in a direction that radiates radio waves.

8. An antenna system according to claim 7, wherein said main reflector includes a plurality of reflector regions having different inclination angles with respect to said ground plate.

9. An antenna system comprising:

a ground plate;

a primary radiator disposed on an upper surface of said ground plate;

a main reflector having a predetermined focal point or a predetermined focal line and standing on the upper surface of said around plate such that said focal point or said focal line substantially corresponds to the location of said primary radiator; and a polarizer, composed of a plurality of grooves an-angled at predetermined intervals and extending in the direction at approximately 45° with respect to the normal line of said ground plate, said polarizer being disposed on a mirror surface of said main reflector facing said primary radiator.

10. An antenna system according to claim 9, wherein the width D of said grooves formed on said main reflector is less than ½ the wavelength λ0 of a radio wave to be received or transmitted, and the height H of said grooves is an odd multiple of ⅛ said wavelength λ0.

11. An antenna system according to claim 9, wherein the width D of said grooves formed on said main reflector is larger than ½ the wavelength λ0 of a radio wave to be received or transmitted, and the width D and the height H of said grooves satisfy the following expression (1):

$$H = (2n-1) \times \frac{\lambda o}{8\left(1-\sqrt{1-\left(\frac{\lambda o}{2D}\right)^2}\right)} \quad (1)$$

$$n = 1, 2, \ldots .$$

12. An antenna system according to claim 9, wherein said primary radiator includes:

a feed probe disposed so as to protrude from the upper surface of said ground plate; and a sub-reflector facing said main reflector via said feed probe and standing in the vicinity of said feed probe on the upper surface of said ground plate.

13. An antenna system according to claim 12, wherein said feed probe is a sleeve dipole antenna element formed by a coaxial line comprising a central conductor and an external conductor, said external conductor having a sleeve folded by a length equal to approximately ¼ of a wavelength, at an end of said coaxial line, said central conductor having a linear conductor extending from the end by a length equal to approximately ¼ said wavelength away from the end.

14. An antenna system according to claim 12, wherein said ground plate is disposed on a base stand and is rotatable with respect to said base stand around said feed probe so as not to contact with said teed probe.

15. An antenna system according to claim 9, wherein said main reflector stands an said upper surface of said ground plate at an angle according to an elevation angle in a direction that receives radio waves or in a direction that radiates radio waves.

16. An antenna system according to claim 15, wherein said main reflector includes a plurality of reflector regions having different inclination angles with respect to said ground plate.

17. An antenna system comprising:

a ground plate;

a primary radiator disposed on an upper surface of said ground plate;

a main reflector having a predetermined focal point or a predetermined focal line and standing on the upper surface of said ground plate such that said focal point or said focal line substantially corresponds to the location of said primary radiator; and a linear conductor element composed of a plurality of linear conductors arranged at predetermined intervals and extending in the direction at approximately 45° with respect to the normal line of said ground plate, said linear conductor element being disposed on a mirror surface of said main reflector facing said primary radiator.

18. An antenna system according to claim 17, wherein the interval between said linear conductors is less than ½ the wavelength λ0 of radio waves to be received or transmitted, and said linear conductor element is disposed in front of said main reflector such that the distance H between the surface of said linear conductor element and the mirror surface of said main reflector is an odd multiple of ⅛ said wavelength λ0.

19. An antenna system accord mg to claim 17, wherein said primary radiator includes:

a feed probe disposed so as to protrude from the upper surface of said ground plate; and a sub-reflector facing said main reflector via said feed probe and standing in the vicinity of said feed probe on the upper surface of said ground plate.

20. An antenna system according to claim 19, wherein said feed probe is a sleeve dipole antenna element formed by a coaxial line comprising a ventral conductor and an external conductor, said external conductor having a sleeve folded by a length equal to approximately ¼ a wavelength, at an end at said coaxial line, said central conductor having a linear conductor extending from the end by a length equal to approximately ¼ said wavelength away from the end.

21. An antenna system according to claim 19, wherein said ground plate is disposed on a base stand and is rotatable with respect to said base stand around said feed probe so as not to contact with said feed probe.

22. An antenna system according to claim 17, wherein said main reflector stands on said upper surface of said ground plate at an angle according to an elevation angle in a direction that receives radio waves or in a direction that radiates radio waves.

23. An antenna system according to claim 22, wherein said main reflector includes a plurality of reflector regions having different inclination angles with respect to said ground plate.

24. An antenna system comprising:

a ground plate;

a primary radiator disposed on an upper surface of said ground plate;

a main reflector having a predetermined focal point or a predetermined focal line and standing on the upper surface of said ground plate such that said focal point or said focal line substantially corresponds to the location of said primary radiator; and a polarizer composed of meander-line conductors for convening a linearly polarized wave and a circularly polarized wave, said polarizer being disposed between said main reflector and said primary radiator, or between said main reflector and an object to which the antenna system radiates radio waves or which radiates radio waves to the antenna system.

25. An antenna system according to claim 24, wherein said primary radiator includes:

a food probe disposed so as to protrude tram the upper surface of said ground plate; and a sub-reflector facing said main reflector via said feed probe and standing in the vicinity of said feed probe on the upper surface of said ground plate.

26. An antenna system according to claim 25, wherein said feed probe is a sleeve dipole antenna element formed by a coaxial line compressing central conductor and an external conductor, said external conductor having a sleeve folded by a length equal to approximately ¼ a wavelength, at an end of said coaxial line, said central conductor having a linear conductor extending from the end by a length equal to approximately ¼ said wavelength away from the end.

27. An antenna system according to claim 25, wherein said ground plate is disposed on a base stand and is rotatable with respect to said base stand around said teed probe so as not to contact with said feed probe.

28. An antenna system according to claim 24, wherein said main reflector stands on said upper surface of said ground plate at an angle according to an elevation angle in a direction that receives radio waves or in a direction that radiates radio waves.

29. An antenna system according to claim 28, wherein said main reflector includes a plurality of reflector regions having different inclination angles with respect to said ground plate.

30. An antenna system comprising:

a ground plate;

a primary radiator disposed on an upper surface of said ground plate; and a main reflector having a predetermined focal point or a predetermined focal line and standing on the upper surface of said ground plate such that said focal point or said focal line substantially corresponds to the location of said primary radiator;

wherein said primary radiator includes:

a feed probe disposed on said ground plate so as to protrude fro the upper surface thereof;

a feed probe external conductor disposed on the ground plate so as to surround said feed probe, said feed probe external conductor being electrically connected to said ground plate;

a feed slot formed in said feed probe external conductor in a portion facing said main reflector; and an antenna element disposed in the vicinity of said feed slot and electromagnetically coupled with said feed probe.

31. An antenna system according to claim 30, wherein said ground plate is disposed on a base stand and is rotatable with respect to said base stand around said feed probe so as not to contact with said feed probe.

32. An antenna system according to claim 30, wherein said main reflector stands on said upper surface of said ground plate at an angle according to an elevation angle in a direction that receives radio waves or in a direction that radiates radio waves.

33. An antenna system according to claim 32, wherein said main reflector includes a plurality of reflector regions having different inclination angles with respect to said ground plate.

34. An antenna system comprising:

a ground plate;

a primary radiator disposed on an upper surface of said ground plate; and a main reflector having a predetermined focal point or a predetermined focal line and standing on the upper surface of said ground plate such that said focal point or said focal line substantially corresponds to the location of said primary radiator, wherein said main reflector includes a plurality of reflector regions having different inclination angles with respect to said ground plate.

35. An antenna system according to claim 34, wherein said primary radiator includes:

a feed probe disposed so as to protrude from the upper surface of maid ground plate; and a sub-reflector facing said main reflector via said feed probe and standing in the vicinity of said feed probe on the upper surface of said ground plate.

36. An antenna system according to claim 35, wherein said feed probe is a sleeve dipole antenna element formed by a coaxial line comprising a central conductor and art external conductor, maid external conductor having a sleeve folded by a length equal to approximately ¼ a wavelength, at an end of said coaxial line, said central conductor having a linear conductor extending from the end by a length equal to approximately ¼ said wavelength away from the end.

37. An antenna system according to claim 35, wherein said ground plate is disposed on a base stand and is rotatable with respect to said base stand around said feed probe so as not to contact with said feed probe.

* * * * *